US006201505B1

(12) United States Patent
Terashima et al.

(10) Patent No.: US 6,201,505 B1
(45) Date of Patent: Mar. 13, 2001

(54) GLASS ANTENNA DEVICE FOR AN AUTOMOBILE

(75) Inventors: Fumitaka Terashima, Aichi; Nobuyasu Ikutame, Tokyo, both of (JP)

(73) Assignee: Asahi Glass Company Ltd., Tokyo (JP)

( * ) Notice: Subject to any disclaimer, the term of this patent is extended or adjusted under 35 U.S.C. 154(b) by 0 days.

(21) Appl. No.: 09/390,294

(22) Filed: Sep. 3, 1999

(30) Foreign Application Priority Data

Sep. 3, 1998 (JP) ..... 10-250112
Mar. 26, 1999 (JP) ..... 11-084505

(51) Int. Cl.[7] ..... H01Q 1/32
(52) U.S. Cl. ..... 343/713; 343/704; 343/860
(58) Field of Search ..... 343/713, 704, 343/860; H01Q 1/32

(56) References Cited

U.S. PATENT DOCUMENTS

| | | | | |
|---|---|---|---|---|
| 5,083,134 | | 1/1992 | Saitou et al. | 343/713 |
| 5,198,825 | | 3/1993 | Sakurai et al. | 343/713 |
| 5,239,302 | | 8/1993 | Maeda et al. | 343/704 |
| 5,598,170 | | 1/1997 | Nakase | 343/713 |
| 5,654,720 | | 8/1997 | Saitou et al. | 343/713 |
| 5,654,721 | | 8/1997 | Saitou et al. | 343/713 |
| 5,699,071 | * | 12/1997 | Urakami et al. | 343/713 |
| 5,877,727 | | 3/1999 | Saitou et al. | 343/713 |
| 5,905,468 | * | 5/1999 | Ikawa et al. | 343/713 |
| 5,907,308 | * | 5/1999 | Oka et al. | 343/713 |
| 6,072,435 | * | 6/2000 | Terashima et al. | 343/713 |

FOREIGN PATENT DOCUMENTS

| | | | |
|---|---|---|---|
| 43 12 259 | 10/1994 | (DE) | H01Q/1/32 |
| 0 629 018 | 12/1994 | (EP) | H01Q/1/32 |
| 2-311002 | 12/1990 | (JP) | H01Q/1/32 |
| 4-287405 | 10/1992 | (JP) | H01Q/1/32 |
| 6-177626 | 6/1994 | (JP) | H01Q/1/32 |
| 9-307333 | 11/1997 | (JP) | H01Q/1/32 |
| 10-126133 | 5/1998 | (JP) . | |

OTHER PUBLICATIONS

Patent Abstracts of Japan, vol. 1998, No. 8, Jun. 30, 1998, JP 10–079615, Mar. 24, 1998.

* cited by examiner

*Primary Examiner*—Hoanganh Le
*Assistant Examiner*—Hoang Nguyen
(74) *Attorney, Agent, or Firm*—Oblon, Spivak, McClelland, Maier & Neustadt, P.C.

(57) ABSTRACT

A glass antenna device capable of receiving well both AM and FM broadcast signals wherein a series resonance is generated by a coil 31 disposed between a defogger 90 and a receiver 7, a parallel resonance is generated by a coil 32 disposed between the defogger 90 and the automobile body as the earth and a high frequency choking coil 52 for blocking FM signals is connected between an antenna conductor 3 and the defogger 90 to prevent the FM signals exited in the antenna conductor 3 from leaking to the automobile body as the earth.

24 Claims, 10 Drawing Sheets

GLASS ANTENNA DEVICE FOR AN AUTOMOBILE

The present invention relates to a glass antenna device for an automobile suitable for receiving signals in, for example, a long wave broadcast band (150–280 kHz), a middle wave broadcast band (520–1700 kHz), a short wave broadcast band (3–30 MHz), an FM broadcast band of Japan (76–90 MHz), an FM broadcast band of U.S.A. (88–108 MHz), a TV-VHF band (90–108 MHz, 170–222 MHz), a TV-UHF band (470–770 MHz) and so on, which is of high sensitivity and low noise and which is rich in productivity.

As a glass antenna device for an automobile which is capable of improving the sensitivity by utilizing resonance, there has been proposed a glass antenna device for an automobile as shown in FIG. 7 (JP-Y-4-53070).

In this conventional example, a defogger 90 comprising heater strips 2 and bus bars 15*a*, 15*b*, 15*c* is provided on a rear window glass sheet 1 fitted to a rear window opening of an automobile. There are the bus bar 15*a* at a lower portion and the bus bar 15*b* at an upper portion on a left side of the defogger 90. The lower bus bar 15*a* is connected to the automobile body as the earth and the upper bus bar 15*b* is connected to an anode of a d.c. power source 10. A fed current flows from the upper bus bar 15*b* through the bus bar 15*c* at a right portion to the lower bus bar 15*a* in a channel-like form. The defogger shown in FIG. 7 is in a so-called channel-like form.

In the glass antenna device shown in FIG. 7, a choke coil 9 is connected between the bus bars 15*a*, 15*b* and the d.c. power source 10 for the defogger 90, and by increasing the impedance of the choke coil 9 in a high frequency band region, a direct current is allowed to pass from the d.c. power source 10 to the defogger 90 but a current in the high frequency band region such as a broadcast band region or the like is blocked whereby the defogger 90 is utilized as an antenna.

Further, a parallel resonance is generated by the stray capacitance to ground (hereinbelow, referred simply as the stray capacitance) of the defogger 90 and a coil 71 in a middle wave broadcast band, and a received signal in the middle wave broadcast band is passed in association with coil 72, a capacitor 73 and a resistor 74. Reference numeral 11 designates a capacitor for cutting noises. In the conventional example having such construction as in FIG. 7, an attempt has been made to improve the sensitivity and to reduce noises.

In the conventional example, however, the stray capacitance of a cable connecting the defogger 90 to a receiver constituted a main factor to cause the parallel resonance. Further, the S/N ratio was poor and the sensitivity was insufficient because there was a parallel resonance frequency in the middle broadcast band.

Further, when the defogger 90 was used as an antenna commonly used for the middle wave broadcast band and the FM broadcast band and if the shape of the defogger 90 was optimized for receiving middle wave broadcast signals, there were problems that the sensitivity and directivity for FM broadcasting were insufficient in a case of receiving FM broadcast signals.

It is an object of the present invention to eliminate the above-mentioned drawbacks of the conventional technique, and to provide a glass antenna device for an automobile which is of high sensitivity; reduces noises and is good in productivity.

In accordance with a first aspect of the present invention, there is provided a glass antenna device for an automobile wherein an electric heating type defogger having heater strips and bus bars for feeding a current to the heater strips, and an antenna conductor are provided on a rear window glass sheet fitted to a rear window opening of an automobile, and a choke coil is connected to at least one between a bus bar and a d.c. power source and between the bus bar and the automobile body as the earth so that a signal in a first frequency band and a signal in a second frequency band which is higher in frequency than the first frequency band are received, the glass antenna device being characterized in that the defogger functions as an antenna so that it receives a signal in at least the first frequency band and sends the signal to a receiver, and the antenna conductor receives a signal in at least the second frequency band and sends the signal to the receiver; a first inductance element and a second inductance element are provided; a first resonance is generated by a resonance element which comprises the impedance of the defogger and the inductance of the first inductance element; a second resonance is generated by a resonance element which comprises the impedance of the defogger and the inductance of the second inductance element; the resonance frequency of the first resonance and the resonance frequency of the second resonance are determined so that the sensitivity of signal in the first frequency band is increased, and a filter circuit for blocking or attenuating a signal in the second frequency band is electrically connected between the antenna conductor and the defogger.

In accordance with a second aspect of the present invention, there is provided a glass antenna device for an automobile wherein an electric heating type defogger having heater strips and bus bars for feeding a current to the heater strips, and an antenna conductor are provided on a rear window glass sheet fitted to a rear window opening of an automobile; a choke coil is connected to at least one between a bus bar and a d.c. power source and between the bus bar and the automobile body as the earth, and the antenna conductor and a receiver are connected with a cable so that a signal in a first frequency band and a signal in a second frequency band which is higher in frequency than the first frequency band are received, the glass antenna device being characterized in that the defogger functions as an antenna so that it receives a signal in at least the first frequency band and sends the signal to the receiver, and the antenna conductor receives a signal in at least the second frequency band and sends the signal to the receiver; a first inductance element and a second inductance element are provided; a first resonance is generated by a resonance element which comprises the impedance of the defogger and the inductance of the first inductance element; a second resonance is generated by a resonance element which comprises the impedance of the cable and the inductance of the second inductance element; the resonance frequency of the first resonance and the resonance frequency of the second resonance are determined so that the sensitivity of signal in the first frequency band is increased, and a filter circuit for blocking or attenuating a signal in the second frequency band is electrically connected between the antenna conductor and the defogger.

Further, in accordance with a third aspect of the present invention, there is provided a glass antenna device for an automobile wherein an electric heating type defogger having heater strips and bus bars for feeding a current to the heater strips, and an antenna conductor are provided on a rear window glass sheet fitted to a rear window opening of an automobile, and a choke coil is connected to at least one between a bus bar and a d.c. power source and between the bus bar and the automobile body as the earth so that a signal in a first frequency band and a signal in a second frequency band which is higher in frequency than the first frequency band are received, the glass antenna device being characterized in that the defogger functions as an antenna so that it receives a signal in at least the first frequency band and sends the signal to a receiver, and the antenna conductor receives a signal in at least the second frequency band and sends the signal to the receiver; a filter circuit for blocking or attenuating a signal in the second frequency band and the first inductance element are electrically connected between a line connecting the defogger to the receiver and the defogger by interposing at least one of a line and a circuit element, and the second inductance element is electrically connected between a line connecting the defogger to the receiver and the automobile body as the earth by interposing at least one of a line and a circuit element.

Further, in accordance with a fourth aspect of the present invention, there is provided a glass antenna device for an automobile wherein an electric heating type defogger having heater strips and bus bars for feeding a current to the heater strips, and an antenna conductor are provided on a rear window glass sheet fitted to a rear window opening of an automobile, and a choke coil is connected to at least one between a bus bar and a d.c. power source and between the bus bar and the automobile body as the earth so that a signal in a first frequency band and a signal in a second frequency band which is higher in frequency than the first frequency band are received, the glass antenna device being characterized in that a first resonance and a second resonance are generated; a first inductance element as a resonance element for the first resonance and a second inductance element are provided; the inductance of the second inductance element, the inductance of the choke coil and the impedance of the defogger are included in resonance elements for the second resonance, and the resonance frequency of the first resonance and the resonance frequency of the second resonance are determined so that the sensitivity of signal in the first frequency band is increased.

Further, in accordance with a fifth aspect of the present invention, there is provided a glass antenna device for an automobile wherein an electric heating type defogger having heater strips and bus bars for feeding a current to the heater strips, and an antenna conductor are provided on a rear window glass sheet fitted to a rear window opening of an automobile, and a choke coil is connected to at least one between a bus bar and a d.c. power source and between the bus bar and the automobile body as the earth, and the antenna conductor and a receiver are connected with a cable so that a signal in a first frequency band and a signal in a second frequency band which is higher in frequency than the first frequency band are received, the glass antenna device being characterized in that a first resonance and a second resonance are generated; a first inductance element as a resonance element for the first resonance and a second inductance element are provided; the inductance of the second inductance element and the stray capacitance of the cable constitute mainly resonance elements for the second resonance, and the resonance frequency of the first resonance and the resonance frequency of the second resonance are determined so that the sensitivity of signal in the first frequency band is increased.

Figure 1:
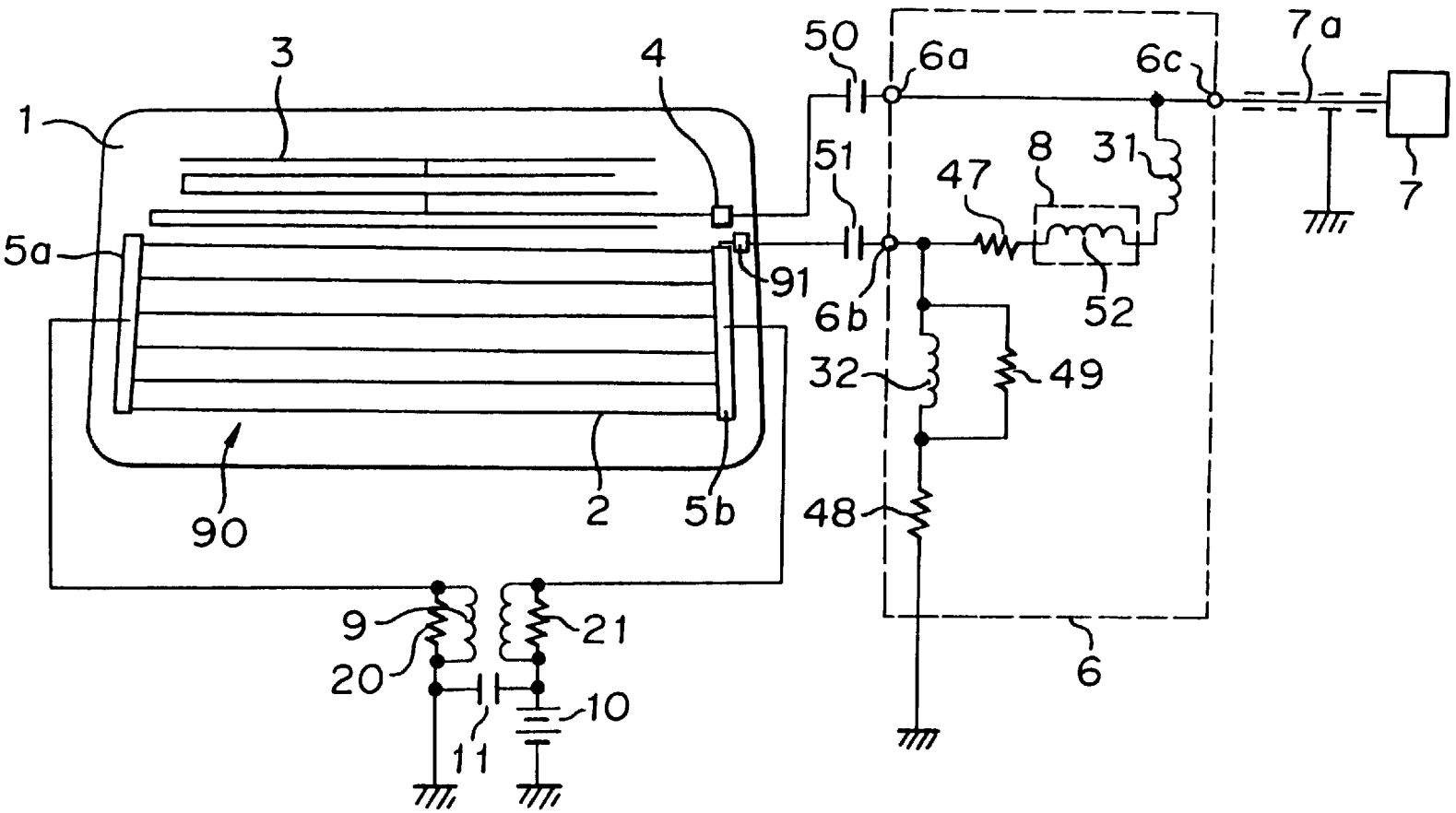
FIG. 1 is a diagram showing the basic structure of an embodiment of the glass antenna device for an automobile according to the present invention.
Figure 3:
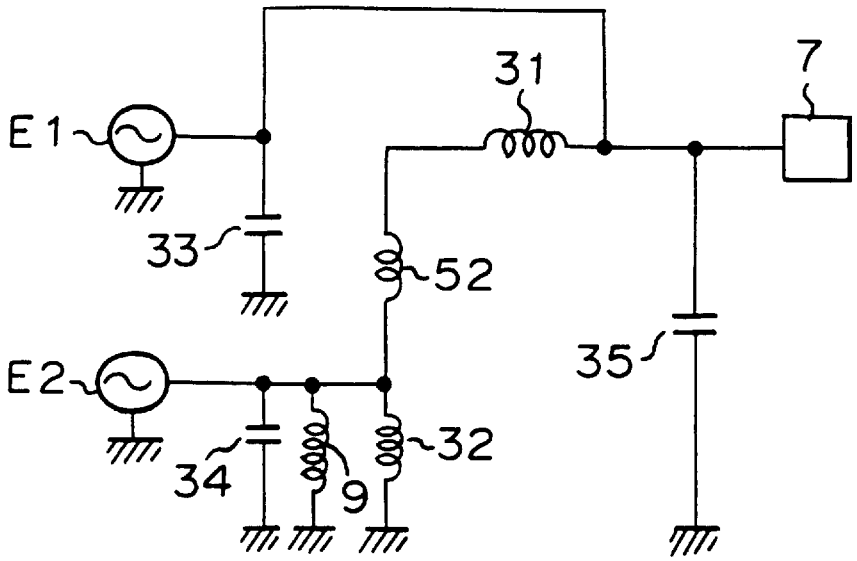
Figure 4:
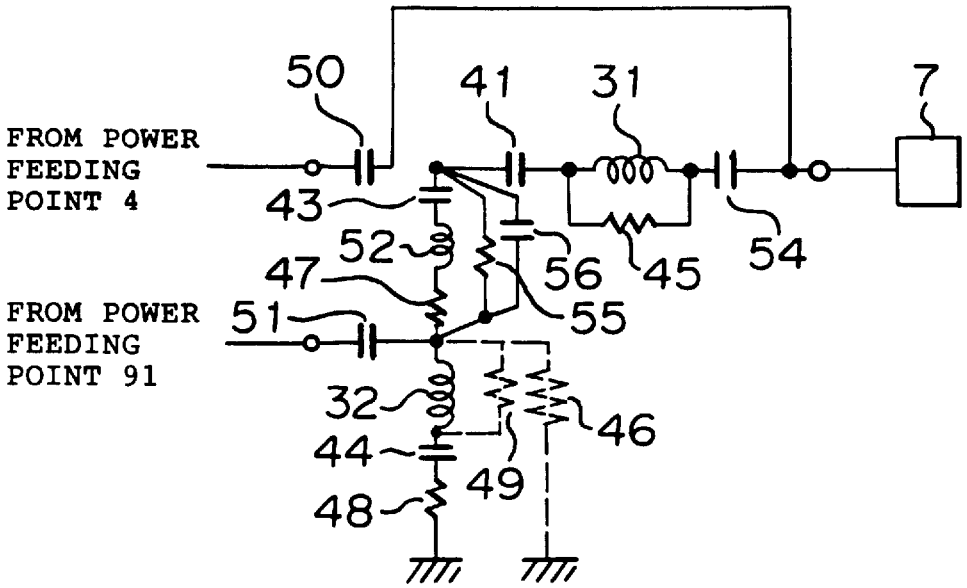
Figure 5:
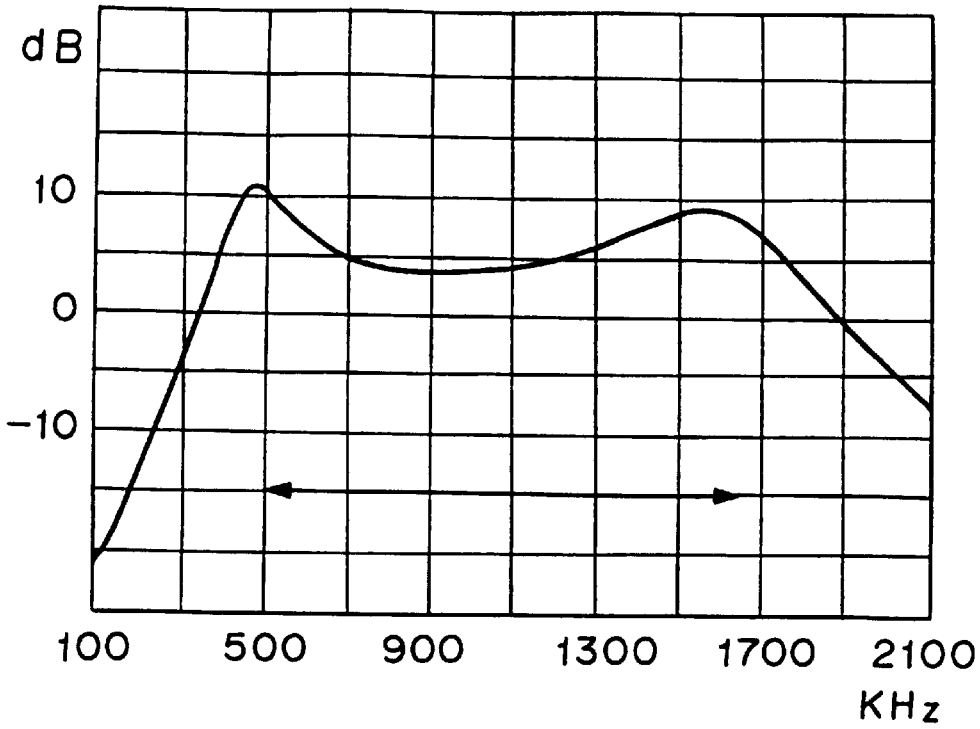
Figure 6:
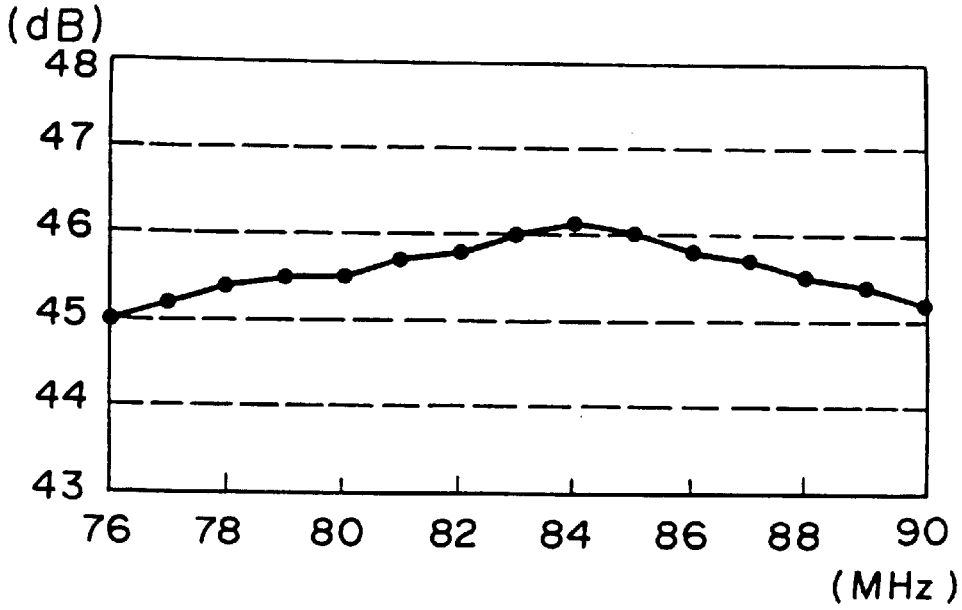
Figure 7:
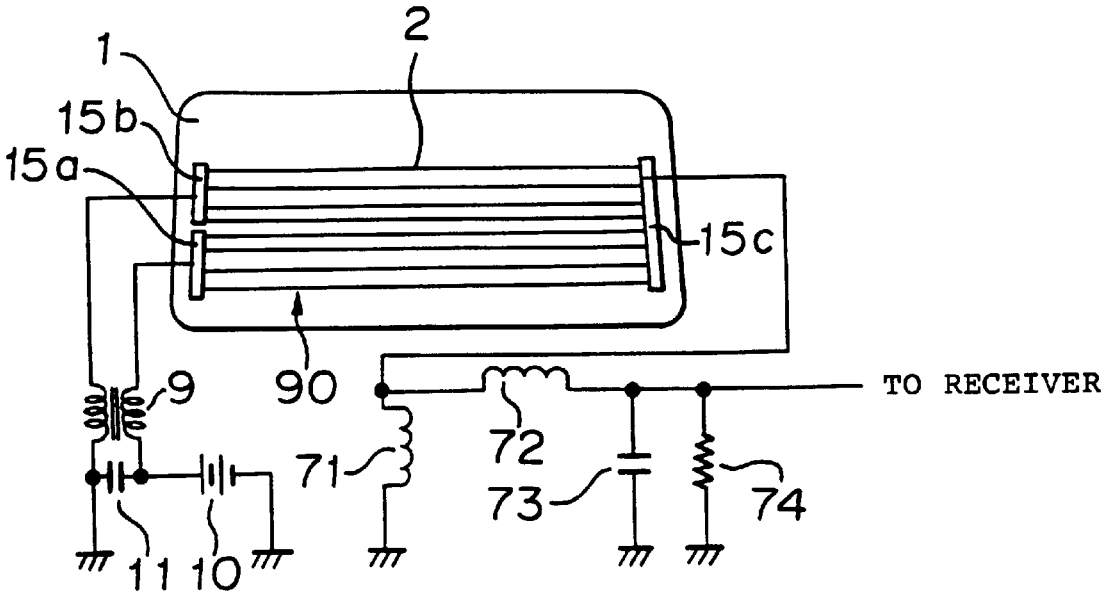
FIG. 7 PRIOR ART
Figure 8:
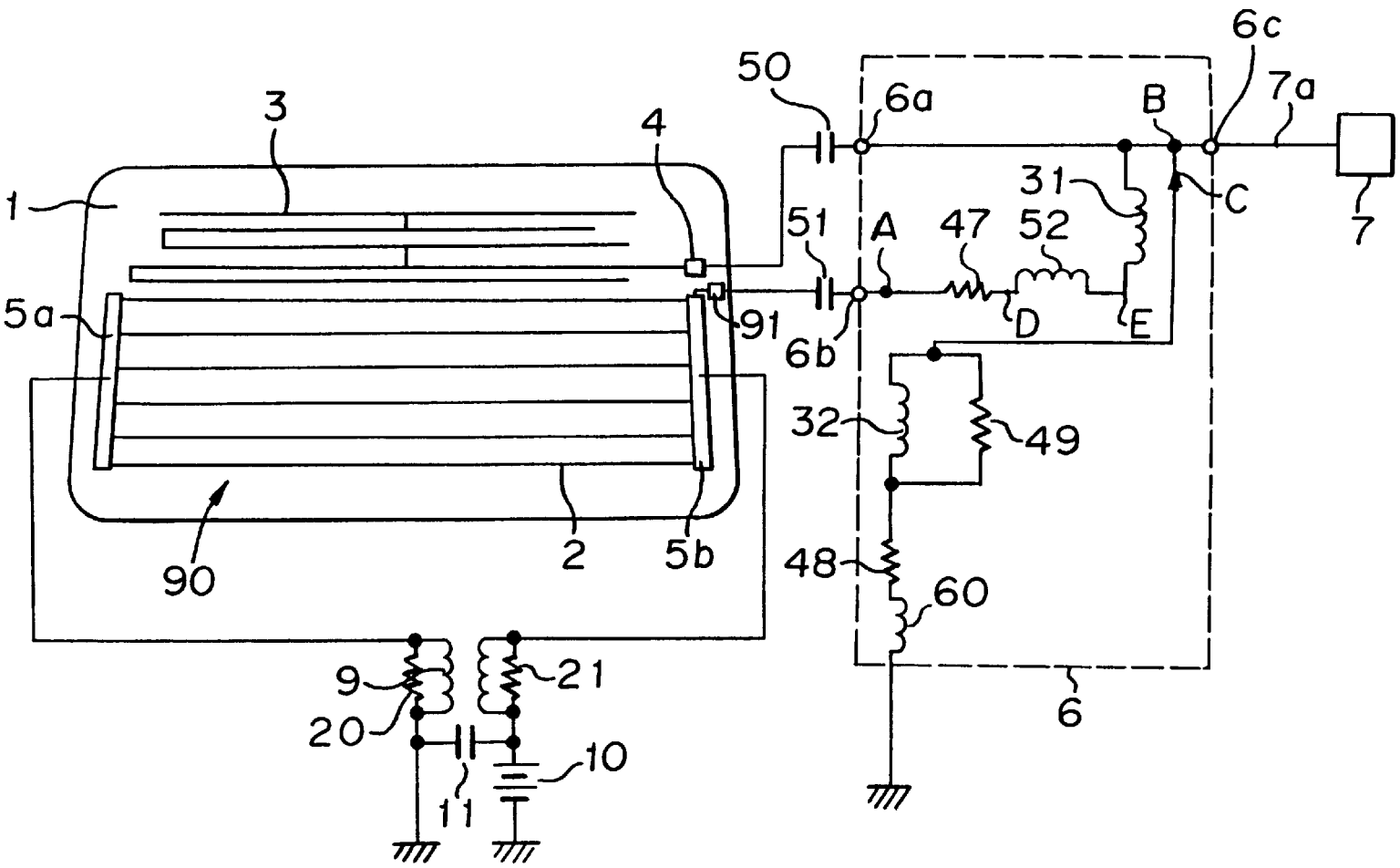
Figure 9:
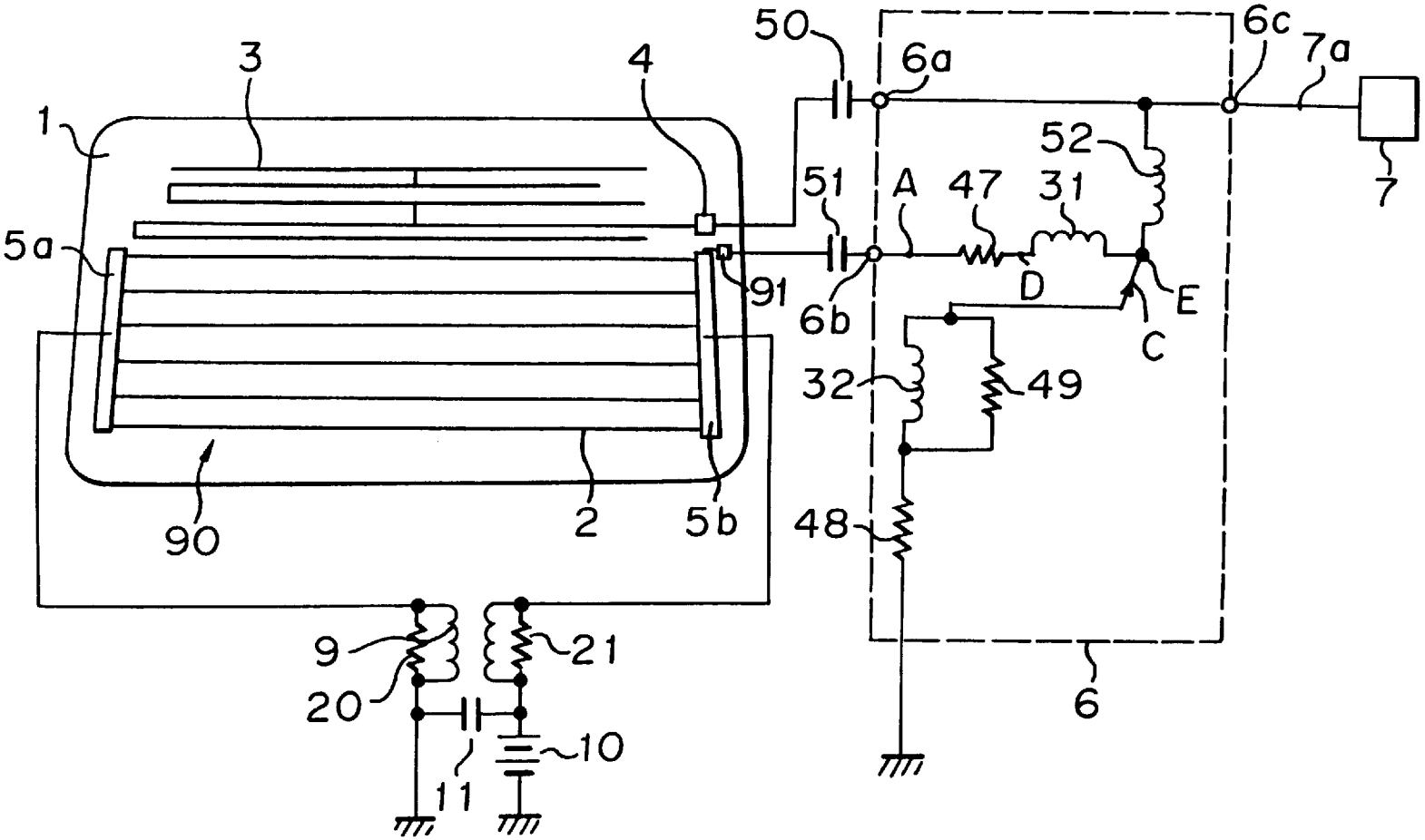
Figure 10:
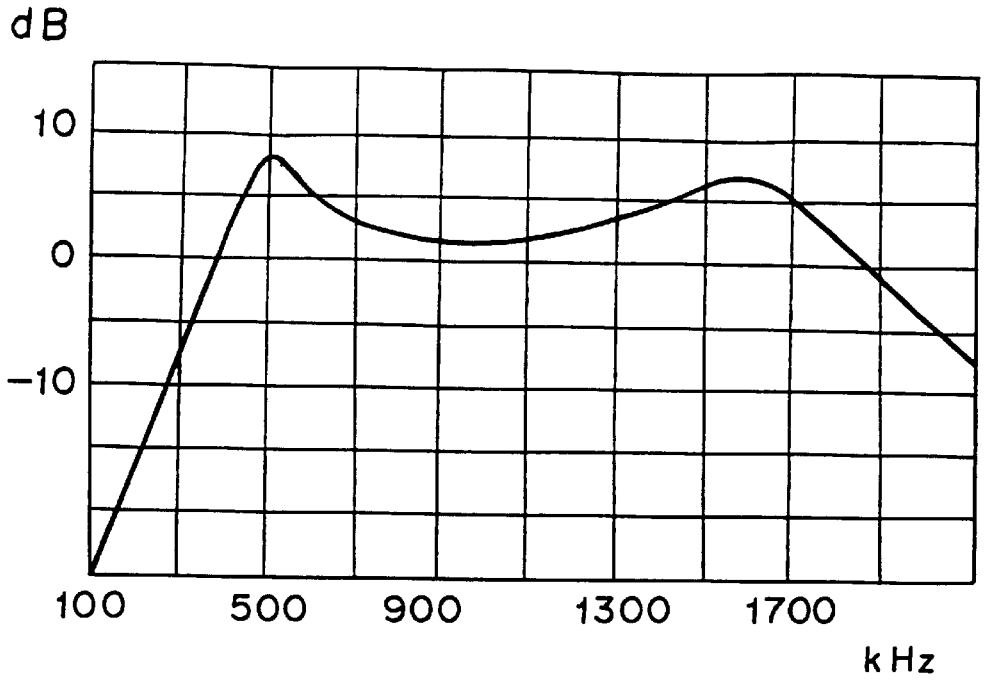
Figure 11:
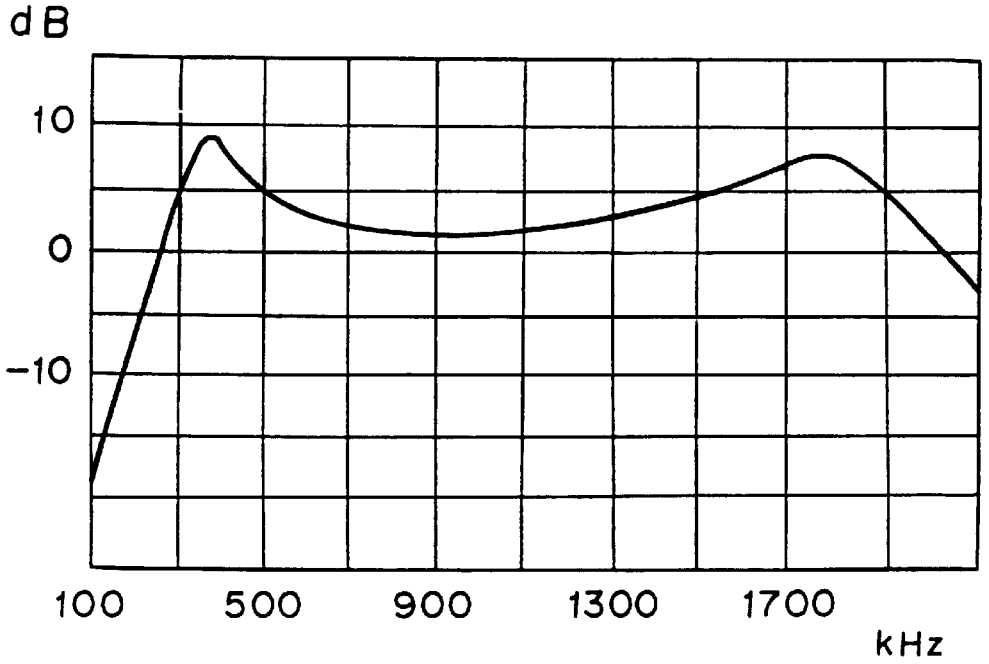
Figure 12:
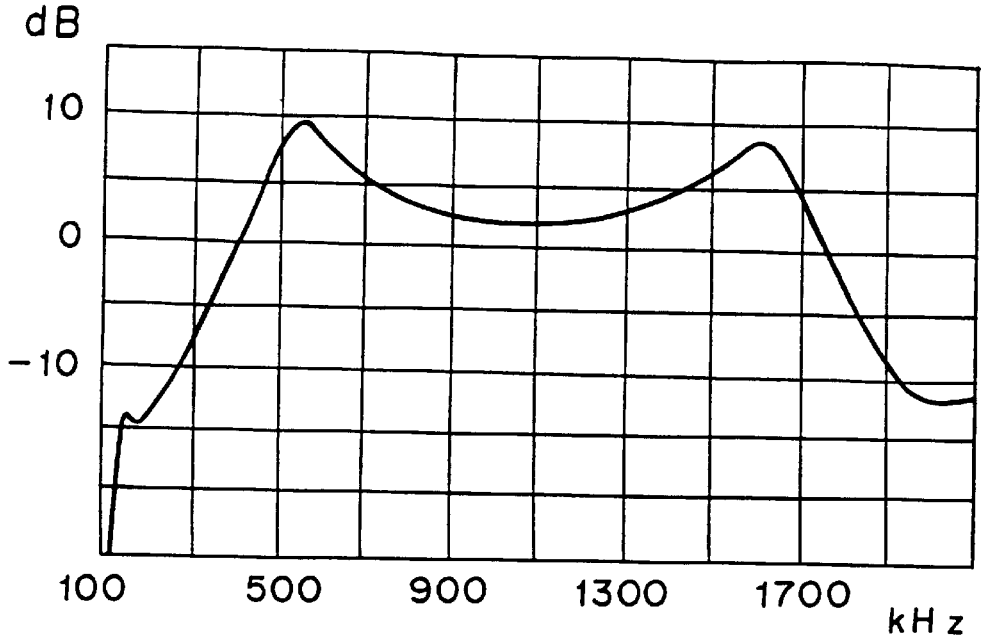
Figure 13:
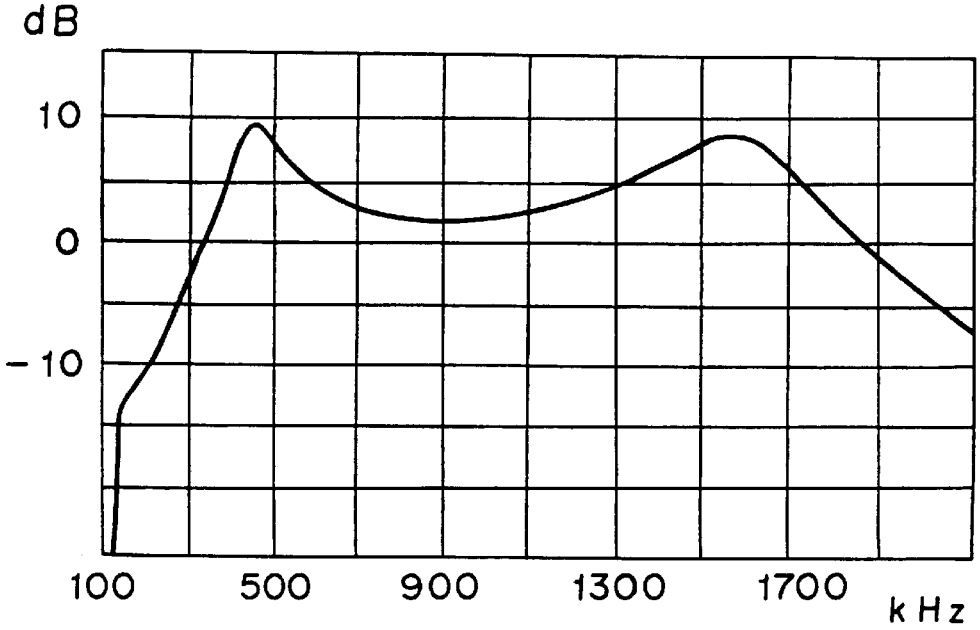
Figure 14:
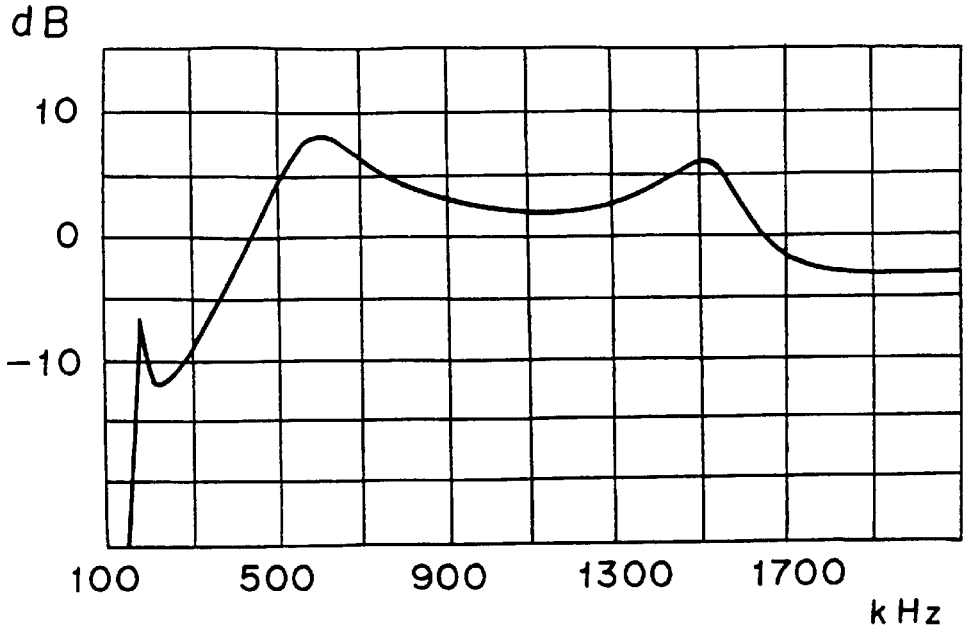
Figure 15:
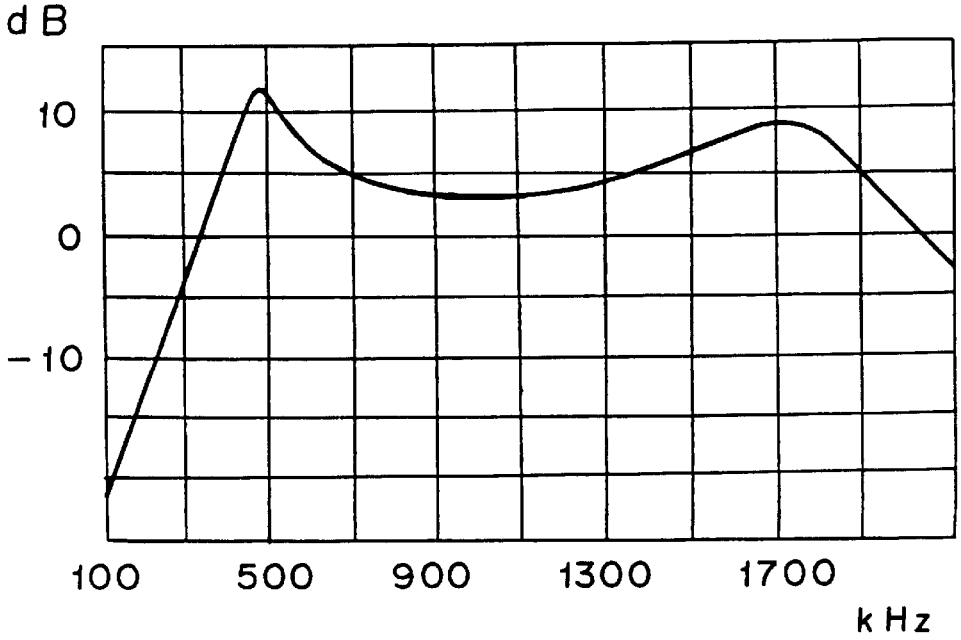

FIG. 3 is an equivalent circuit diagram for explaining the function of an antenna conductor 3, a defogger 90 and a resonance circuit 6 in the glass antenna shown in FIG. 1;

FIG. 4 is a circuit diagram showing a modified example of the resonance circuit 6;

FIG. 5 is a characteristic diagram of frequency vs sensitivity in comparing a pole antenna for a middle wave broadcast band concerning example 1;

FIG. 6 is a characteristic diagram of frequency vs sensitivity for an FM broadcast band concerning example 1;

FIG. 7 is a diagram showing a conventional glass antenna;

FIG. 8 is a diagram showing an embodiment of the glass antenna of a type separate from that in FIG. 1;

FIG. 9 is a diagram showing another embodiment of the glass antenna of the present invention wherein the order of connecting a first coil 31 and a high frequency choking coil 52 is changed from that in FIG. 8;

FIG. 10 is a characteristic diagram of frequency vs sensitivity in comparing a pole antenna for a middle broadcast band in example 2;

FIG. 11 is a characteristic diagram of frequency vs sensitivity in comparing a pole antenna for a middle broadcast band in example 3;

FIG. 12 is a characteristic diagram of frequency vs sensitivity in comparing a pole antenna for a middle wave broadcast band in example 4;

FIG. 13 is a characteristic diagram of frequency vs sensitivity in comparing a pole antenna for a middle wave broadcast band in example 5;

FIG. 14 is a characteristic diagram of frequency vs sensitivity in comparing a pole antenna for a middle wave broadcast band in example 6; and FIG. 15 is a characteristic diagram of frequency vs sensitivity in comparing a pole antenna for a middle wave broadcast band in example 7.

Detailed description of preferred embodiments of the present invention will be described with reference to the drawings.

FIG. 1 is a diagram showing the basic structure of an embodiment of the glass antenna device for an automobile of the present invention wherein a rear window glass sheet 1 fitted to a rear window opening of an automobile is used. In FIG. 1, reference numeral 2 designates heater strips, numeral 3 an antenna conductor, numeral 4 a power feeding point for the antenna conductor 3, numerals 5*a*, 5*b* designate bus bars, numeral 6 designates a resonance circuit, numeral 6*a* a first input terminal for the resonance circuit 6, numeral 6*b* a second input terminal for the resonance circuit 6, numeral 6*c* an output terminal for the resonance circuit 6, numeral 7 a receiver, numeral 7*a* a cable, numeral 8 a filter circuit, numerals 20, 21 designate damping resistors, numeral 31 designates a first coil as a first inductance element, numeral 32 a second coil as a second inductance element, numeral 47 designates a resistor for reducing automobile noises such as engine noises or the like, numerals 48, 49 designate damping resistors, numerals 50, 51 capacitors for cutting a direct current, numeral 52 designates a high frequency choking coil as a high frequency choking inductance element, numeral 90 a defogger and numeral 91 a power feeding point provided at an end of an outgoing line connected to the defogger 90.

In explanation described below, directions are indicated as directions on the drawings unless particularly specified. The resistors 47, 48, 49 and the high frequency choking coil 52 are provided according to requirement.

The first coil 31 is preferably used as a first inductance element; the second coil 32 is preferably used as a second inductance element, and the high frequency choking coil 52 is preferably used as a high frequency choking inductance element.

In the glass antenna device for an automobile shown in FIG. 1, the power feeding point 4 and the first input terminal 6*a* of the resonance circuit 6 are electrically connected by interposing the capacitor 50 therebetween, and the output terminal 6*c* of the resonance circuit 6 is electrically connected to the input terminal of the receiver 7 by interposing the cable 7*a*. In other words, in the glass antenna device for an automobile shown in FIG. 1, the power feeding point 4 is electrically connected to the input terminal of the receiver 7 (in FIG. 1, the former is connected to the later with respect to high frequency signals), and received signals at the power feeding point 4 are supplied to the input terminal of the receiver 7. As the cable for connecting electrically the output terminal 6*c* of the resonance circuit 6 to the input terminal of the receiver 7, a co-axial cable is preferably used from the standpoint of reducing noises, however, it is not in particular limited to use the co-axial cable as far as noises can be reduced.

Since the second input terminal 6*b* of the resonance circuit 6 and the power feeding point 91 are electrically connected by interposing the capacitor 51 therebetween and the output terminal 6*c* of the resonance circuit 6 and the input terminal of the receiver 7 are electrically connected by interposing the cable 7*a* therebetween, the first coil 31 and the filter circuit 8 are electrically connected between a line connecting the antenna conductor 3 to the receiver 7 and the power feeding point 91. In more detail, the line connecting the antenna conductor 3 to the receiver 7 and the power feeding point 91 are electrically connected by a serial connection circuit of the first coil 31, the filter circuit 8 and the resistor 47. Accordingly, the first coil 31 and the filter circuit 8 are connected between the line connecting the antenna conductor 3 to the receiver 7 and the defogger 90.

It is not always necessary to connect the first coil 31 to the filter circuit 8 in the manner as shown in FIG. 1, and it is sufficient that the first coil 31 and the filter circuit 8 are electrically connected between the line connecting the antenna conductor 3 to the receiver 7 and the defogger 90 by interposing at least one of a line and a circuit element. The power feeding point 91 is provided according to requirement. The second input terminal 6*b* may be connected directly to the bus bar 5*b* without providing the power feeding point 91.

In this specification, the circuit element includes any element usable for a semiconductor device and a circuit such as a capacitor, a coil, a resistor, a diode, a transistor or the like. Further, the line means an electrical connection with a wire or an electrical connection with a conductor pattern or a connector provided on a circuit substrate. In FIG. 1, "the antenna conductor 3 and the defogger 90 are electrically connected" which is obtainable from capacitive coupling of the antenna conductor 3 to the defogger 90 excludes the line as defined above.

In FIG. 1, the filter circuit 8 is composed of the high frequency choking coil 52. Although it is preferable to constitute the filter circuit 8 by the high frequency choking coil 52 in order to simplify the circuit structure of the filter circuit 8, the glass antenna device of this embodiment is not limited thereto, and another circuit structure can be used as the circuit structure for the filter circuit 8.

The second input terminal 6*b* of the resonance circuit 6 and the power feeding point 91 are electrically connected by interposing the capacitor 51 therebetween, and a serial connection circuit comprising the second coil 32 and the resistor 48 are electrically connected between the second input terminal 6*b* of the resonance circuit 6 and the automobile body as the earth. In other words, the second coil 32 is electrically connected between the power feeding point 91 and the automobile body as the earth (in FIG. 1, they are connected with respect to high frequency signals). The way for connecting the second coil 32 is not in particular limited to the embodiment as shown in FIG. 1, and instead, the second coil 32 may be electrically connected between the power feeding point 91 and the automobile body as the earth by interposing at least one of a line and a circuit element. In this specification, the automobile body as the earth indicates an electric conductive portion of the automobile body, which is usually made of a conductive material such as metal.

In the circuit structure shown in FIG. 1, received signals in the defogger 90, which are to be passed through the first coil 31, and received signals in the antenna conductor 3 are synthesized and supplied to the receiver 7. Further, in FIG. 1, the received signals in the antenna conductor 3 are fed through the capacitor 50 and the received signals are synthesized with the received signals from the defogger 90 before the synthesized signals are supplied to the receiver 7. However, the received signals in the antenna conductor 3 may be fed through a circuit element such as a coil, a resistor or the like, other than the capacitor, to be synthesized with the received signals from the defogger 90 before the synthesized signals are supplied to the receiver 7.

In FIG. 1, there is a serial connection of the resistor 47, the high frequency choking coil 52 and the first coil 31 in order, in the observation from a second input terminal 6*b* side, between the second input terminal 6*b* and the output terminal 6*c*. In the present invention, however, it is not always necessary to use such order of connection, and there are varieties of the order of connection usable, e.g., an order comprising the resistor 47, the first coil 31 and the high frequency choking coil 52, an order comprising the high frequency choking coil 52, the first coil 31 and the resistor 47, an order comprising the high frequency choking coil 52, the resistor 47 and the first coil 31, an order comprising the first coil 31, the resistor 47 and the high frequency choking coil 52 or an order comprising the first coil 31, the high frequency choking coil 52 and the resistor 47.

FIG. 3 shows an equivalent circuit diagram for explaining the principle of the glass antenna device shown in FIG. 1 wherein the resistors 47, 48 and 49 are omitted for simplifying the explanation; the portion of resistor 49 is opened, and the portions of the resistors 47 and 48 are short-circuited.

In FIG. 3, E1 designates a signal voltage power source for the antenna conductor 3, E2 designates a signal voltage power source for the defogger 90, numeral 33 designates the stray capacitance of the antenna conductor 3, numeral 34 designates the stray capacitance of the defogger 90 and numeral 35 designates the stray capacitance of the cable 7*a*. When the antenna conductor 3 is disposed close to the defogger 90 to have a capacitive coupling relation, the close capacitance due to the capacitive coupling is connected in parallel to the high frequency choking coil 52. The stray capacitance 33 is generally 10–100 pF and the stray capacitance 34 is generally 50–300 pF.

The antenna conductor 3 is preferably used for receiving signals in a second frequency band (hereinbelow, referred to as a high frequency band) which is higher in frequency than a first frequency band (hereinbelow, referred to as a low frequency band), and it is preferable that the length and the shape of the antenna conductor 3 are determined to obtain a desired signal receiving performance in the high frequency band.

The antenna conductor 3 and the defogger 90 can be used for receiving signals in a middle broadcast band, an FM broadcast band, a short wave broadcast band, a long wave broadcast band, a TV-VHF band, a TV-UHF band and telephone. For example, the low frequency band is used for the middle wave broadcast band and the high frequency band is for at least one of the FM broadcast band, the TV-VHF band and the TV-UHF band.

In the present invention, the sensitivity to signals can be improved by generating resonance in two portions. For the first resonance, the impedance of the defogger 90 and the inductance of the first coil 31 are included as resonance elements.

The impedance of the defogger 90 is the impedance of a side of the defogger 90 viewed from the power feeding point 91. The impedance of the defogger 90 is mainly the stray capacitance 34.

Since the defogger 90 and the antenna conductor 3 are electrically connected by means of a line and/or a capacitive coupling (in FIG. 1, there are connected with respect to high frequency signals), the impedance of the antenna conductor 3 influences also the first resonance, and it can be a resonance element for the first resonance.

The impedance of the antenna conductor 3 is mainly the stray capacitance 33. The impedance of the antenna conductor 3 is the impedance of a side of the antenna conductor 3 viewed from the power feeding point 4. Further, a resonance frequency for the first resonance may be adjusted by connecting a capacitive component in parallel between the stray capacitance 34 and the automobile body as the earth. The capacitive component can also be a resonance element for the first resonance. For the first resonance, the stray capacitance of a line located around the first coil 31, the stray capacitance of the cable connected between the glass antenna and the receiver 7 (in a case of FIG. 1, the stray capacitance 35) or the like influence also, and they can be resonance elements for the first resonance.

Impedance matching may be conducted between the defogger 90 and the receiver side by providing a new circuit element in the resonance circuit 6. The first coil 31 is generally about 10 $\mu$H–1 mH. When the low frequency band is for the middle broadcast band, 50–500 $\mu$H is preferred, and 65–350 $\mu$H is more preferred to improve the sensitivity. For the second resonance, the inductance of the second coil 32 and/or inductance of the choke coil 9 and the impedance of the defogger 90 are included as resonance elements. For the second coil 32, a coil having about 10 $\mu$H–1 mH is generally used. When the low frequency band is for the middle wave band, 100 $\mu$H–1 mH is preferable, and 300–850 $\mu$H is more preferable from the viewpoint of improving the sensitivity. Further, the resonance circuit 6 is preferably provided in the rear window glass sheet 1 or in the vicinity of the rear window glass sheet 1 so that the first resonance and the second resonance can be generated smoothly.

As described before, since the antenna conductor 3 and the defogger 90 are electrically connected, (in FIG. 1, they are connected with respect to high frequency signals), the impedance of the antenna conductor 3 influences also the second resonance, and it can be a resonance element for the second resonance. Further, the stray capacitance of a line located around the antenna conductor 3, the stray capacitance of a line around the defogger 90, the stray capacitance of a line around the second coil 32 and so on influence also the second resonance, and they can be resonance elements for the second resonance. Further, the stray capacitance of the cable connected between the output terminal of the resonance circuit 6 and the receiver (in a case of FIG. 1, the stray capacitance 35) or the like influences also the second resonance.

In FIG. 1, the first resonance is a series resonance and the second resonance is a parallel resonance, which are preferably generated from the viewpoint of improving the sensitivity. In the present invention, however, the first resonance is not limited to a series resonance and the second resonance is not limited to a parallel resonance. Accordingly, the first resonance may be a parallel resonance and the second resonance may be a series resonance.

The function of the capacitor 51 will be described. The capacitor 51 is a circuit element to be provided according to requirement. If the capacitor 51 is not provided, and the location of the capacitor 51 is short-circuited, a direct current to be fed to the defogger 90 will flow into the second coil 32. Accordingly, a capacity of current for the second coil 32 should be increased, which reduces productivity. Further, since the direct current flowing to the defogger 90 flows to the automobile body as the earth through the coil 32, there is a waste of current. Accordingly, the capacitor 51 functions to block the direct current. Accordingly, it is preferable to provide the capacitor 51.

In FIG. 1, the capacitor 51 is connected between the power feeding point 91 and the second coil 32 and the power feeding point 91 is connected to the bus bar **5*b*. Accordingly, the capacitor 51 is connected between the bus bar 5*b* and the second coil 32. However, the way of connection of the capacitor 51 is not limited to the embodiment shown in FIG. 1. The capacitor 51 may be connected between the bus bar 5*a* and the second coil 32, or it may be connected between the heater strips 2 and the second coil 32. In other words, the position of the defogger 90 to which the second coil 32** is electrically connected, is not limited.

In a case that both the inductance of the second coil 32 and the impedance of the choke coil 9 are resonance elements for the second resonance in FIG. 1 will be described. The inductance of a parallel connection circuit of the second coil 32 and the choke coil 9 and the impedance of the defogger 90 are included as resonance elements for the second resonance. In this case, it is preferable that the inductance value $L_2$ of the second coil 32 and the inductance value $L_{CH}$ of the choke coil 9 satisfy a relation of $1.5\times L_2 \leqq L_{CH}$, more preferably a relation of $2\times L_2 \leqq L_{CH}$. Since a large current of several tens A (ampare) which flows into the defogger 90 is passed to the choke coil 9, the current capacity has to be increased. In a large scale production of choke coil, there is generally a scattering of about ±30% in $L_{CH}$. Accordingly, there causes a scattering in a resonance frequency for the second resonance, and accordingly, there causes a scattering in the sensitivity to signals in a low frequency band. Such disadvantage can be avoided by satisfying $L_2$ and $L_{CH}$ with the above-mentioned relations.

In the glass antenna device for an automobile shown in FIG. 1, the inductance of the parallel connection circuit of the second coil 32 and the choke coil 9 is the main inductance for generating the second resonance. Accordingly, the satisfaction of the relation of $1.5\times L_2 \leqq L_{CH}$ reduces the influence of the inductance of the choke coil 9 to the second resonance, and accordingly, the scattering of the resonance frequency for the second resonance can be reduced. In the case of $1.5\times L_2 \leqq L_{CH}$, the scattering of the inductance of the parallel connection circuit comprising the second coil 32 and the choke coil 9 can be reduced to ±15% or less even when there is a scattering of ±30% in $L_{CH}$. When both the inductance of the second coil 32 and the inductance of the choke coil 9 are resonance elements for the second resonance and when the case of FIG. 1 applies, the inductance of the parallel connection circuit of the second inductance element and the choke coil and the impedance of the defogger are main resonance elements for the second resonance.

In FIG. 1, the resonance frequency of the first resonance and the resonance frequency of the second resonance are determined to be such ones to improve the sensitivity of signals in the low frequency band. Further, the high frequency choking coil 52 as an inductance element generally separates in terms of high frequency the antenna conductor 3 from the defogger 90 in the high frequency band, and functions to improve the sensitivity in the high frequency band without changing the effective length of conductor of the antenna conductor 3.

Further, in a case that the high frequency choking coil 52 is not provided and the location of the high frequency choking coil 52 is short-circuited, the self-resonance frequency of the choke coil 9 or the second coil 32 is low and shows a capacitive property. Accordingly, received signals in a high frequency band excited in the antenna conductor 3 leak to the automobile body as the earth. Therefore, the high frequency choking coil 52 is to be provided to prevent the leakage. In other words, the high frequency choking coil 52 functions as a filter circuit 8 to pass signals in the low frequency band and blocks or attenuates signals in the high frequency band.

Further, when the low frequency band is for a middle wave broadcast band and the high frequency band is for at least one of an FM broadcast band, a TV-VHF band and a TV-UHF band, the high frequency choking coil 52 should have an inductance value in a range of 0.1–100 $\mu$H. When the inductance value of the high frequency choking coil 52 is within the range of 0.1–100 $\mu$H, the sensitivity in the high frequency band is improved 0.2 dB or more in comparison with a case out of the range of 0.1–100 $\mu$H.

In particular, when the low frequency band is for a middle wave broadcast band and the high frequency band is for an FM broadcast band, the high frequency choking coil 52 has preferably an inductance value in a range of 0.3–20 $\mu$H. In the case of the range of 0.3–20 $\mu$H, the sensitivity in the FM broadcast band is improved 0.5 dB or more in comparison with a case out of the range of 0.3–20 $\mu$H. Further, the high frequency choking coil 52 is more preferably of an inductance value in a range of 0.8–4.8 $\mu$H. When the inductance value of the high frequency choking coil 52 is within the range of 0.8–4.8 $\mu$H, the sensitivity in the FM broadcast band is improved 2 dB or more in comparison with a case out of the range of 0.8–4.8 $\mu$H.

With respect to the self-resonance frequency $f_R$ of the high frequency choking coil 52, a relation of $f_H/15 \leqq f_R \leqq 3\ f_L$ should be satisfied between the highest frequency $f_H$ of the high frequency band and the lowest frequency $f_L$ of the high frequency band. When $f_R$ is within this range, the sensitivity in the high frequency band is generally improved 0.5 dB or more in comparison with a case having a range out of this range. Further, it is more preferable to satisfy a condition of $f_H/9 \leqq f_R \leqq 2\ f_L$. When $f_R$ is within this range, the sensitivity in the high frequency band is generally improved 0.5 dB or more in comparison with a case having a range out of this range. Further, it is in particular preferable to satisfy a condition of $f_H/3 \leqq f_R \leqq 1.85\ f_L$. When $f_R$ is within this range, the sensitivity in the high frequency band is generally improved 0.5 dB or more in comparison with a case having a range out of this range.

Accordingly, for example, when the high frequency band is used for an FM broadcast band in Japan, a preferred range of the self-resonance frequency fR of the high frequency choking coil 52 is 6–228 MHz, more preferably, 10–152 MHz, and particularly preferably, 30–140 MHz. When the high frequency band is for an FM broadcast band in U.S.A., a preferred range of the self-resonance frequency $f_R$ of the high frequency choking coil 52 is 7.2–264 MHz, more preferably, 12–176 MHz, and particularly preferably, 36–162 MHz.

In an equivalent circuit of the high frequency choking coil 52, a parallel circuit of a coil and a capacitor is obtainable wherein the parallel resonance frequency of the coil and the capacitor is a self-resonance frequency.

In FIG. 1, it is preferable for the antenna conductor 3 and the defogger 90 to have no capacitive coupling relation. When they have a capacitive coupling relation, received signals in the high frequency band, excited in the antenna conductor 3, are apt to leak to the automobile body as the earth through the defogger 90 and the choke coil 9. In order to prevent the antenna conductor 3 and the defogger 90 from having a capacitive coupling relation, the shortest distance between the antenna conductor 3 and the defogger 90 should generally be 5 mm or more. When the shortest distance is 5 mm or more, the sensitivity in the high frequency band is generally improved 0.5 dB or more in comparison with a case that the shortest distance is less than 5 mm. More preferably, the shortest distance should generally be 10 mm or more. In this case, the sensitivity in the high frequency band is generally improved 0.5 dB or more in comparison with a case that the shortest distance is less than 10 mm. In particular, the shortest distance should generally be 20 mm or more. In this case, the sensitivity in the high frequency band is generally improved 0.5 dB or more in comparison with a case that the shortest distance is less than 20 mm.

The above-mentioned condition of the shortest distance between the antenna conductor 3 and the defogger 90 is generally applied to a case that the length of portions extending in substantially parallel in the antenna conductor 3 and the defogger 90 is 100 mm or more.

The damping resistors 20, 21 are provided according to requirement, and these are provided to adjust the Q (quality factor) for the second resonance whereby the sensitivity of received signals is flattened. The resistance value of the damping resistors 20, 21 is generally 10 Ω–500 kΩ. When the low frequency is for a middle wave broadcast band, the resistance value of the damping resistors 20, 21 should be 1–100 kΩ, in particular, 2–50 kΩ.

Figure 2:
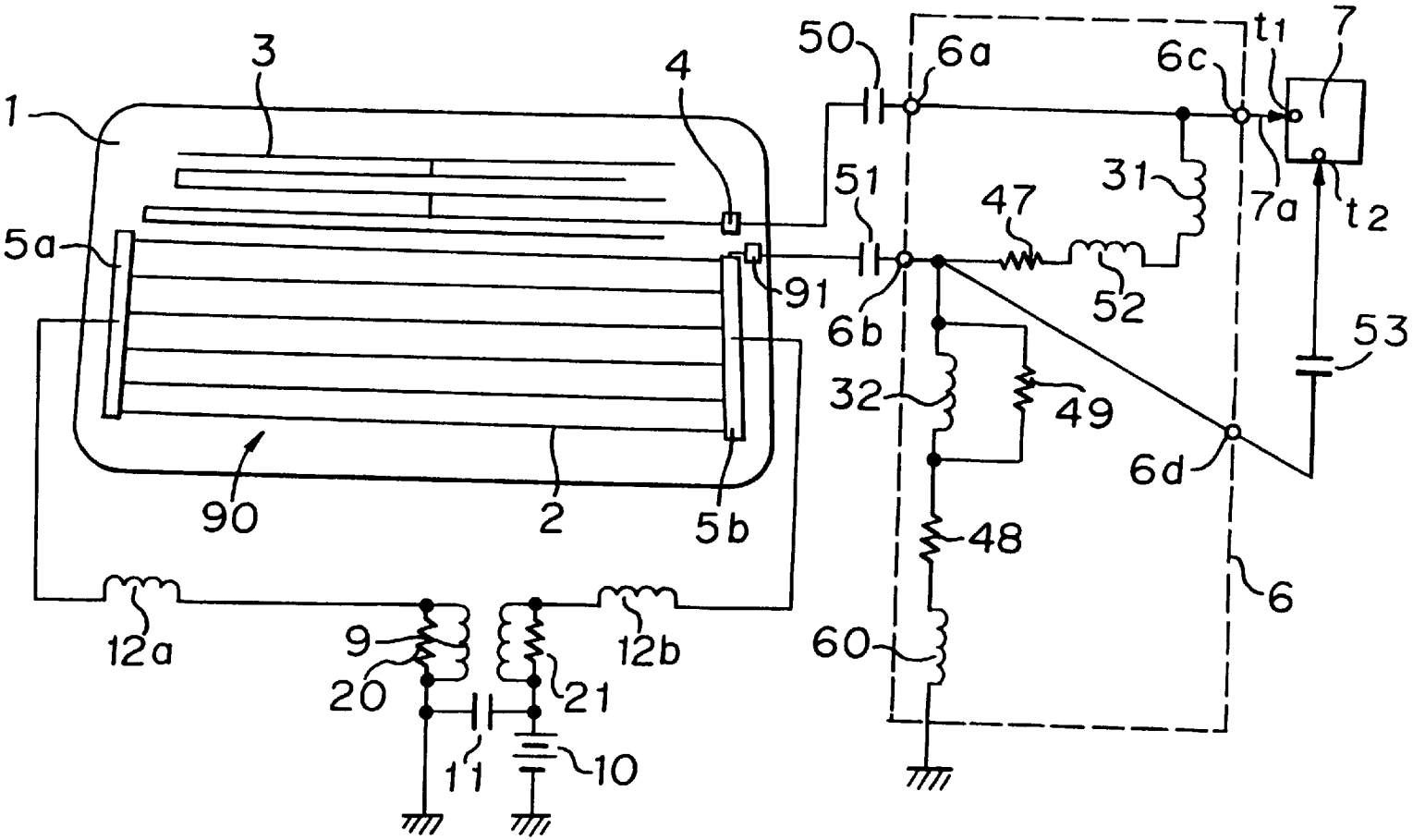
FIG. 2 is a diagram of another embodiment of the glass antenna device of the present invention.

FIG. 2 shows a modified form of the glass antenna device for an automobile shown in FIG. 1 wherein it is adaptable to diversity signal reception. In FIG. 2, reference numeral **6*d* an output terminal of the resonance circuit 6, numerical 53 designates a capacitor, numeral 60 designates a high frequency choking coil, symbol $t_1$ designates a first input terminal of the receiver 7 and symbol $t_2$ designates a second input terminal of the receiver 7. The receiver 7** is adapted to select a stronger received signal of high frequency band at either the first input terminal $t_1$ or the second input terminal $t_2$.

The capacitor 53 is provided according to requirement, which functions to block or attenuate received signals in the low frequency band. When the low frequency band is for a middle wave broadcast band and the high frequency band is for an FM broadcast band, the capacitance value of the capacitor 53 is preferably within a range of 10–150 pF, more preferably, 20–70 pF. When the capacitance value of the capacitor 53 is 10 pF or more, the sensitivity in the FM broadcast band is generally improved 1 dB or more at the second input terminal $t_2$ in comparison with a case that the capacitance value is less than 10 pF. Further, when the capacitance value of the capacitor 53 is 150 pF or less, the sensitivity in the middle wave broadcast band is generally improved 1 dB or more at the first input terminal $t_1$ in comparison with a case that the capacitance value exceeds 150 pF. Further, when the capacitance value of the capacitor 53 is 20 pF or more, the sensitivity in the FM broadcast band is generally improved 1 dB or more at the second input terminal $t_2$ in comparison with a case of the value being less than 20 pF. Further, when the capacitance value of the capacitor 53 is 70 pF or less, the sensitivity in the middle wave broadcast band is generally improved 1 dB or more at the first input terminal $t_1$ in comparison with a case of the capacitance value exceeding 70 pF.

A case that the second coil 32 exhibits a capacitive property in a high frequency and such as an FM broadcast band among several broadcast bands, received signals leak to the automobile body as the earth whereby the sensitivity is reduced. In order to prevent such disadvantage, the high frequency choking coil 60 may be connected in series to the second coil 32. The high frequency choking coil 60 having about 0.1–100 $\mu$H is generally used.

In the glass antenna device for an automobile shown in FIG. 2, it is preferable to connect a high frequency choking coil 12*a* and/or a high frequency choking coil 12*b* between the bus bars 5*a*, 5*b* and the automobile body as the earth. Since received signal of high frequency band, which are not used in the device shown in FIG. 1, excited in the defogger 90 are used at the second input terminal $t_2$, the received signals of high frequency band excited in the defogger 90 are prevented from leaking to the automobile body as the earth by means of the high frequency choking coils 12*a*, 12*b*.

In FIG. 2, the second input terminal $t_2$ of the receiver 7 is drawn from the inside of the resonance circuit 6 (a left end of the capacitor 53 is connected to a point in the resonance circuit 6). However, the drawing point for the second input terminal $t_2$ is not limited to the inside of the resonance circuit 6 but it may be drawn from any point of the defogger 90. Further, an antenna conductor which is separated from the antenna conductor 3 may be provided in a space which is lower in position than the defogger 90 so as to conduct diversity signal reception between the first input terminal $t_1$ and the separate antenna conductor.

FIG. 8 is a diagram showing another embodiment of the present invention which is separated from that shown in FIG. 1 wherein symbol A designates a point in a line extending between the defogger 90 and the resistor 47, symbol B designates a point in a line extending between the power feeding pint 4 and the receiver 7, symbol C designates a point connected to an end of the second coil 32, the point being opposite to the side of automobile body as the earth, and symbols D and E designate points extending in a line between the point A and the point B. In the glass antenna device shown in FIG. 1, the point C is connected to the point A. However, in the glass antenna device shown in FIG. 8, the point C is connected to the point B.

The glass antenna device of the present invention is not limited to the constructions as shown in FIGS. 1 and 8 but the point C may be connected to any point of the line between the point A and the point B. In other words, the second coil 32 may be electrically connected between the line connecting the defogger 90 to the receiver 7 and the automobile body as the earth by interposing at least one of a line and a circuit element. For example, the point C may be connected to the point D, or the point C may be connected to the point E. However, it is preferable that the point C is connected to the point A or the point D. In other words, it is preferable that the point C is connected to a point of line which is closer to the defogger 90 rather than the high frequency choking coil 52.

The reason is as follows. When the point C is connected to the point E or the point B, i.e., when the point C is connected to a point in a line between the receiver 7 and the defogger 90, the point being remote from the defogger 90 with respect to the high frequency choking coil 52, it is necessary to provide the high frequency choking coil 60 as a high frequency choking inductance element because received signals of high frequency band at the point B leak to the automobile body as the earth.

In FIG. 8, it is preferable that the antenna conductor 3 and the defogger 90 are not in a capacitive coupling relation. When they are brought into a capacitive coupling relation, received signals in a high frequency band excited in the antenna conductor 3 are apt to leak to the automobile body as the earth through the defogger 90 and the choke coil 9. This function is performed in the same manner as that in FIG. 1.

In FIG. 8, the point C is connected to a point of line which is closer to the receiver 7 rather than the first coil 31. Accordingly, the impedance of the cable 7*a* influences largely the second resonance in comparison with a case that the point C is connected to a point of line which is closer to the defogger 90 rather than the first coil 31. Namely, there causes the second resonance by a resonance element comprising the impedance of the cable 7*a* and the inductance of the second coil 32. In FIG. 8, the second resonance is a parallel resonance wherein the impedance of the cable 7*a* is mainly comprised of a stray capacitance 35. When the resonance circuit 6 is provided in the rear window glass sheet 1 or when the resonance circuit 6 is provided in the vicinity of the rear window glass sheet 1, the length of the cable 7*a*is several meters and the capacitance value of the stray capacitance 35 is generally 50–300 pF since the receiver 7 is usually provided in a front portion of the automobile body.

Even in the case of FIG. 8, the first resonance is generated by a resonance element comprising the impedance of the defogger 91 and the inductance of the first coil 31. In FIG. 8, the first resonance is a series resonance. In the glass antenna device shown in FIG. 8, the stray capacitances 33, 35 and the close capacitance between the antenna conductor 3 and the defogger 90 influence the second resonance in comparison with the case of the glass antenna device shown in FIG. 1. Further, all the conditions described with reference to FIG. 1, such as circuit constants, the self-resonance frequency $f_R$ of the high frequency choking coil 53, the shortest distance between the antenna conductor 3 and the defogger 90 and so on, can be applied to the embodiment shown in FIG. 8 or an embodiment which will be described with reference to FIG. 9.

In the embodiments shown in FIGS. 8 and 9, when the point C is connected to a point of line which is closer to the receiver 7 rather than the first coil 31, a third resonance may be generated in addition to the first resonance and the second resonance. The third resonance is caused by a resonance element which comprises mainly the inductance of the choke coil 9 and the impedance of the defogger 90. However, the third resonance should not be generated as possible. When a frequency of noises exists in the vicinity of the resonance frequency of the third resonance, good signal receiving performance can not be expected because of suffering influence of noises. The third resonance can be suppressed by making the capacitor 50 smaller. The capacitance value of the capacitor 51 to suppress the third resonance is preferably 2,000 pF or less, in particular, 1,000 pF or less.

When the third resonance is generated, the inductance of the choke coil 9 and the impedance of the defogger 90 constitute mainly resonance elements for the third resonance. Further, the resonance frequency of the third resonance is preferably lower than the resonance frequency of the second resonance because influence to the sensitivity in the low frequency band due to a scattering of $L_{CH}$ in a large scale production can be reduced. From such reason, when the low frequency band is used for a middle wave broadcast band, the resonance frequency of the third resonance is preferably 50–450 kHz, more preferably, 100–400 kHz or lower, and in particular, 150–350 kHz or lower.

FIG. 9 is a diagram showing an embodiment which is a modified form of the embodiment shown in FIG. 8 wherein the order of connection of the first coil 31 and the high frequency choking coil 52 is changed. In FIG. 9, the resistor 47, the first coil 31 and the high frequency choking coil 52 are connected in this order in view of a side of the second input terminal 6*b* between the second input terminal 6*b* and the output terminal 6*c*, and the point C is connected to the point E in the line between the first coil 31 and the high frequency choking coil 52. In FIG. 9, since the point C is connected to the line extending between the second input terminal 6*b* and the output terminal 6*c* and at a point closer to the defogger 90 rather than the high frequency choking coil 52, received signals in the high frequency band at the output terminal 6*c* are blocked by the high frequency choking coil 52 to prevent the signals from leaking to the automobile body as the earth. Accordingly, in this embodiment, it is unnecessary to provide the high frequency choking coil 60 as in FIG. 8.

In the present invention, it is preferable from the viewpoint of reducing noises that the resonance circuit 6 is located in the rear window glass sheet 1 or in the vicinity of the rear window glass sheet 1. However, it may be in the rear window glass sheet 1 or in the vicinity of the rear window glass sheet 1, e.g., in the vicinity of the receiver 7 or in the receiver 7.

The reason why resonance is generated in two portions in the present invention is because only a single resonance can not cover a broader signal frequency band region. In the present invention, accordingly, a low frequency band region is divided into two portions with respect to the substantially central frequency wherein the divided portions are respectively shared by the two portions of resonance so that the sensitivity is to be flattened. Here, the flattening of the sensitivity means that a difference between the highest sensitivity and the lowest sensitivity in the low frequency band region is reduced.

A resonance frequency for the first resonance and a resonance frequency for the second resonance are determined to be frequencies by which the sensitivity in the low frequency band is improved. However, it is preferable from the viewpoint of flattening the sensitivity that a resonance frequency for the first resonance exists between a frequency of 1.5 times as much as the highest frequency $f_{LH}$ of the low frequency band and a substantially central frequency of the low frequency band, and a resonance frequency for the second resonance exists between a frequency of 0.6 time as much as the lowest frequency $f_{LL}$ of the flow frequency band and a substantially central frequency of the low frequency band. When the above-mentioned resonance frequencies are out of these ranges, it is difficult that a difference between the highest sensitivity and the lowest sensitivity in the low frequency band is generally reduced to about 10 dB or less, and the flatness in the sensitivity in the low frequency band is poor.

Further, it is preferable from the viewpoint of improving the sensitivity that the resonance frequency for the first resonance is in the low frequency band region. When it is in the low frequency band region, the sensitivity in the entire low frequency band region is generally improved about 10 dB in comparison with a case that the resonance frequency is not. Accordingly, in order to improve both aspects of the flatness and the sensitivity, the resonance frequency for the first resonance should be between the before-mentioned fLH and the substantially central frequency of the low frequency band, and the resonance frequency for the second resonance between a frequency of 0.6 time as much as the before-mentioned $f_{LL}$ and the substantially central frequency of the low frequency band.

When the first resonance is a series resonance, the resonance frequency for the first resonance is preferably higher than the substantially central frequency of the low frequency band. When the second resonance is a parallel resonance, the resonance frequency for the second resonance is preferably lower than the substantially central frequency of the low frequency band. When the second resonance is a parallel resonance, there is a remarkable reduction of the sensitivity in a range lower than the resonance frequency in the parallel resonance.

When the low frequency band is used for a middle wave broadcast band, a preferred range of a resonance frequency for the parallel resonance is 318–1,080 kHz in considering an aspect of flattening the sensitivity. Further, in the consideration for improving the S/N ratio, it is preferable that the resonance frequency for the parallel resonance is 350–530 kHz, more preferably, 450–500 kHz.

FIG. 4 is a circuit diagram showing a modified embodiment of the resonance circuit 6. In FIG. 4, reference numeral 41, 44, 50, 51 and 54 designate capacitors for cutting a direct current, numeral 43 designates a coupling capacitor, numerals 45, 46, 48 and 49 designate damping resistors, numeral 55 designates a resistor for adjusting coupling and numeral 56 designates a capacitor for adjusting coupling.

In the resonance circuit in FIG. 4, received signals in the defogger 90 are transmitted to a side of the receiver through the capacitor 51, the resistor 47 and the capacitor 43. However, when the antenna conductor 3 and the defogger 90 have a capacitive coupling relation, received signals in the defogger 90 are transmitted to the receiver side through the close capacitance. The capacitors 43 and 56 are to adjust the coupling between the antenna conductor 3 and the defogger 90, which are used according to requirement. Further, the resistors 45, 46, 48, 49 and 55 which are to improve the flatness of the sensitivity, are provided according to requirement. Further, a capacitor for adjusting the resonance frequency may be provided.

The capacitors 41, 43, 44, 50, 51 and 54 are provided according to requirement. The capacitors 41, 44, 51 and 54 used are usually of 100 pF–50 $\mu$F. The capacitor 50 used is usually of 1 pF–1 $\mu$F. The capacitor 43 used is usually of 5–500 pF. The resistors 45, 46, 49 and 55 used are usually of 50 Ω–100 kΩ.

When the low frequency band is used for a long wave broadcast band or a middle wave broadcast band and the high frequency band is for an FM broadcast band or a TV-VHF band, a preferred range of capacitance of the capacitor 50 is 4.0–220 pF. In this range, the sensitivity in the FM broadcast band and the TV-VHF band is generally improved 0.5 dB or more in comparison with a case that the capacitance is out of this range. When the capacitance of the capacitor 50 is 100 pF or less, the sensitivity in the middle wave broadcast band is generally improved several dB or more in comparison with a case of the capacitance exceeding 100 pF, which is preferable when signals in the middle wave broadcast band are to be received.

The capacitance value of the capacitor 51 is preferably within a range of 100 pF–10 μF. In this range, the sensitivity in the long wave broadcast band and the middle wave broadcast band is generally improved 0.5 dB or more in a case that the value is out of this range.

Further, a lead wire for feeding a direct current from the d.c. power source 10 to the defogger 90 may take noises of the automobile such as engine noises to invite deterioration of the S/N ratio. The resistor 47 is disposed according to requirement, which prevents the deterioration of the S/N ratio. In particular, it functions to prevent the deterioration of the S/N ratio in the middle wave broadcast band. Namely, the resistor 47 functions to reduce noises of the automobile such as engine noises. Further, the resistor 47 functions as a damping resistor for the first resonance and flattens the sensitivity of signals in the low frequency band.

The resistance value of the resistor 47 is preferably 10 Ω–1 kΩ, more preferably, 50–500 Ω. When signals in a middle wave broadcast band are received as those in the low frequency band and the resistance value of the resistor 47 is determined to be 10 Ω–1 kΩ, the S/N ratio in the middle wave broadcast band is improved 1 dB or more in comparison with a case that the range is out of 10 Ω–1 kΩ. Further, when the resistance value of the resistor 47 is to be 50–500 Ω, the S/N ratio in the middle wave broadcast band is improved 1 dB or more in comparison with a case that the range is out of 50–500 Ω.

As described above, the capacitors 41, 43, 44, 50, 51, 54 and 56 and resistors 45, 46, 47, 48, 49 and 55 in FIG. 4 are provided according to requirement, or they may be omitted. Here, the omission of the capacitor 56 and the omission of the resistors 45, 46, 49 and 55 imply opening, and the omission of the capacitors 41, 43, 44, 50, 51 and 54 and the omission of the resistors 47 and 48 imply short-circuiting.

In FIG. 2, the choke coil 9 and the high frequency choking coils 12*a*, 12*b* are inserted between the bus bars 5*a*, 5*b* and the d.c. power source 10 for the defogger 90 to thereby increase the impedance of the choke coil 9 and the high frequency choking coils 12*a*, 12*b* in a broadcast frequency band region, whereby a direct current from the d.c. power source 10 to the defogger 90 is allowed to flow and a current in the broadcast frequency band region is blocked.

Thus, the heater strips 2 and the bus bars 5*a*, 5*b* in the defogger 90 are isolated from the automobile body as the earth with respect to a high frequency signal by means of the choke coil 9 and the high frequency choking coils 12*a*, 12*b*, whereby a current of received signal of broadcast frequency band region induced in the defogger 90 is prevented from flowing into the automobile body as the earth, and the current of received signal is supplied to the receiver without any leakage. The choke coil 9 generally used is of about 0.1–10 mH.

The high frequency choking coils 12*a*, 12*b* and the high frequency choking coil 60 provide a high impedance in a high frequency band such as an FM broadcast frequency band in a broadcast frequency band. Accordingly, a solenoid or a magnetic core is generally used. Such element exhibits an inductive type inductance in a high frequency band such as an FM broadcast frequency band or in the vicinity of such frequency band region.

When the choke coil 9 exhibits a low self-resonance frequency in a high frequency band such as an FM broadcast band and shows a capacitive property, the high frequency choking coils 12*a*, 12*b* act for it. For the high frequency choking coils 12*a*, 12*b*, ones having about 0.1–100 μH are usually used. From the same reason as the above, when the second coil exhibits a low self-resonance frequency in a high frequency band such as an FM broadcast band and shows a capacitive property, the high frequency choking coil 60 acts for it.

When the choke coil 9 exhibits a capacitive property in a high frequency band such as an FM broadcast band, the high frequency choking coils 12*a*, 12*b* become unnecessary. In short, when only signals in a low frequency band such as a middle wave broadcast band are to be received, the high frequency choking coils 12*a*, 12*b* are generally unnecessary and it is enough to provide only the choke coil 9. When signals in only a high frequency band such as an FM broadcast band are to be received, only the high frequency choking coils 12*a*, 12*b* are required. Further, if any coil or coils which perform both functions of the choke coil 9 and the high frequency choking coils 12*a*, 12*b* can be provided in a case of receiving signals in a low frequency band and a high frequency band, such coil or coils may be used.

In FIG. 1, the choke coil 9 is connected both between the bus bar 5*b* and the d.c. power source 10 and between the bus bar 5*a* and the automobile body as the earth from the viewpoint of improving the sensitivity. However, the choke coil 9 can be connected either between the bus bar 5*b* and the d.c. power source 10 or between the bus bar 5*a* and the automobile body as the earth.

The defogger 90 shown in FIG. 1 or FIG. 2 is substantially in a trapezoidal form, however, the defogger 90 of the present invention is not limited thereto, and a channel-like defogger 90 as shown in FIG. 7 may be utilized in the present invention.

In the present invention, the antenna conductor 3 may be provided in a space of upper, lower, left or light portion with respect to the defogger 90 in the window glass sheet 1 and the position is not limited to that shown in FIG. 1. Further, the number of antenna conductors to be provided is not limited. Further, the glass antenna device of the present invention may perform diversity signal reception in association with an antenna device such as a pole antenna device or another glass antenna device.

Either of the antenna conductor 3 or the defogger 90 shown in FIG. 1 is not provided with an auxiliary antenna conductor. For phase adjustment and directivity adjustment, an auxiliary antenna conductor having a substantially T-like shape or a substantially L-like shape may be connected to a suitable position of a conductor pattern or a power feeding point.

EXAMPLE

Example 1

A rear window glass sheet for an automobile was used and a glass antenna device as shown in FIG. 1 was prepared. The damping resistors 20, 21 were not provided, and the portions corresponding to the resistors 20, 21 were opened. Further, the resistor 48 was not provided, and the portion corresponding to the resistor 48 was short-circuited. The circuit constants of the elements used are shown in Table 1.

The length of conductor and the shape of conductor of the antenna conductor 3 were adjusted so that signals in a middle wave broadcast band and an FM broadcast band could be received. The distance between a lower portion of the antenna conductor 3 and the highest position of strip of the heater strips 2 was spaced to be 21 mm. In this case, the antenna conductor 3 and the defogger 90 had a slight capacitive relation.

FIG. 5 is a characteristic diagram of frequency vs sensitivity in a middle wave broadcast band in comparison with using a pole antenna. In FIG. 5, the range of arrow mark indicates a middle wave broadcast band region. In FIG. 5, the sensitivity of the pole antenna having a length of 910 mm is compared with that of the glass antenna device of the present invention wherein the sensitivity of the pole antenna is 0 dB. The same conditions of pole antenna as described above are applied to description made with reference to FIGS. 10 to 15. FIG. 6 is a characteristic diagram of frequency vs sensitivity in an FM broadcast band.

TABLE 1

| | |
|---|---|
| First coil 31: | 120 μH |
| Second coil 32: | 560 μH |
| High frequency choking coil 52: | 2.2 μH |
| Self-resonance frequency of high frequency choking coil 52: | 90 MHz |
| Resistor 47: | 220 Ω |
| Resistor 49: | 10 kΩ |
| Capacitor 50: | 22 pF |
| Capacitor 51: | 2,200 pF |
| Choke coil 9: | 1.6 mH |
| Stray capacitance of defogger 90: | 100 pF |

Example 2

A glass antenna device was prepared in the same manner as Example 1 except that the circuit constants of the elements were determined as shown in Table 2. FIG. 10 is a characteristic diagram of frequency vs sensitivity in comparison with a pole antenna for a middle wave broadcast band. With respect to frequency-sensitivity characteristics in an FM broadcast band, the substantially same result as Example 1 could be obtained.

TABLE 2

| | |
|---|---|
| First coil 31: | 120 μH |
| Second coil 32: | 330 μH |
| Self-resonance frequency of second coil 32: | 9 MHz |
| High frequency choking coil 52: | 2.2 μH |
| Self-resonance frequency of high frequency choking coil 52: | 90 MHz |
| Resistor 47: | 220 Ω |
| Resistor 49: | 4.7 kΩ |
| Capacitor 50: | 22 pF |
| Capacitor 51: | 2,200 pF |
| Choke coil 9: | 1.6 mH |
| Self-resonance frequency of choke coil 9: | 0.4 MHz |
| Stray capacitance of defogger 90: | 100 pF |
| Stray capacitance of antenna conductor 3: | 80 pF |
| Close capacitance of antenna conductor 3 and defogger 90: | 20 pF |
| Stray capacitance of cable 7a: | 120 pF |

Example 3

A glass antenna device was prepared in the same manner as Example 1 except that the circuit constants of the elements were determined as in Table 3. FIG. 11 is a characteristic diagram of frequency vs sensitivity in comparison with a pole antenna for a middle wave broadcast band. With respect to frequency-sensitivity characteristics in an FM broadcast band, the substantially same result as Example 1 was obtained.

TABLE 3

| | |
|---|---|
| First coil 31: | 70 μH |
| Second coil 32: | 800 μH |
| Self-resonance frequency of second coil 32: | 4 MHz |
| High frequency choking coil 52: | 10 μH |
| Self-resonance frequency of high frequency choking coil 52: | 40 MHz |
| Resistor 47: | 220 Ω |
| Resistor 49: | 10 kΩ |
| Capacitor 50: | 22 pF |
| Capacitor 51: | 2,200 pF |
| Choke coil 9: | 2.5 mH |
| Self-resonance frequency of choke coil 9: | 0.58 MHz |
| Stray capacitance of defogger 90: | 50 pF |
| Stray capacitance of antenna conductor 3: | 30 pF |
| Close capacitance of antenna conductor 3 and defogger 90: | 20 pF |
| Stray capacitance of cable 7a: | 180 pF |

Example 4

A glass antenna device was prepared in the same manner as Example 1 except that the circuit constants of the elements were determined as shown in Table 4. FIG. 12 is a characteristic diagram of frequency vs sensitivity in comparison with a pole antenna for a middle wave broadcast band. With respect to frequency-sensitivity characteristics in an FM broadcast band, the substantially same result as Example 1 was obtained.

TABLE 4

| | |
|---|---|
| First coil 31: | 180 μH |
| Second coil 32: | 400 μH |
| Self-resonance frequency of second coil 32: | 1.8 MHz |
| High frequency choking coil 52: | 1.0 μH |
| Self-resonance frequency of high frequency choking coil 52: | 130 MHz |
| Resistor 47: | 120 Ω |
| Resistor 49: | 5 kΩ |
| Capacitor 50: | 22 pF |
| Capacitor 51: | 220 pF |
| Choke coil 9: | 2.5 mH |
| Self-resonance frequency of choke coil 9 | 0.4 MHz |
| Stray capacitance of defogger 90: | 180 pF |
| Stray capacitance of antenna conductor 3: | 30 pF |
| Close capacitance of antenna conductor 3 and defogger 90: | 50 pF |
| Stray capacitance of cable 7a: | 60 pF |

Example 5

A glass antenna device was prepared in the same manner as Example 1 except that the circuit constants of the elements were determined as shown in Table 5. FIG. 13 is a characteristic diagram of frequency vs sensitivity in comparison with a pole antenna for a middle wave broadcast band. With respect to frequency-sensitivity characteristics in an FM broadcast band, the substantially same result as Example 1 was obtained.

TABLE 5

| | |
|---|---|
| First coil 31: | 150 μH |
| Second coil 32: | 1,200 μH |

TABLE 5-continued

| | |
|---|---|
| Self-resonance frequency of second coil 32: | 1.5 MHz |
| High frequency choking coil 52: | 5.0 μH |
| Self-resonance frequency of high frequency choking coil 52: | 70 MHz |
| Resistor 47: | 20 Ω |
| Resistor 49: | 3.3 kΩ |
| Capacitor 50: | 22 pF |
| Capacitor 51: | 500 pF |
| Choke coil 9: | 0.6 mH |
| Self-resonance frequency of choke coil 9 | 1.5 MHz |
| Stray capacitance of defogger 90: | 80 pF |
| Stray capacitance of antenna conductor 3: | 60 pF |
| Close capacitance of antenna conductor 3 and defogger 90: | 10 pF |
| Stray capacitance of cable 7a: | 150 pF |

Example 6

A glass antenna device was prepared in the same manner as Example 1 except that the circuit constants of the elements were determined as shown in Table 6. FIG. 14 is a characteristic diagram of frequency vs sensitivity in comparison with a pole antenna for a middle wave broadcast band. With respect to frequency-sensitivity characteristics in an FM broadcast band, the substantially same result as Example 1 was obtained.

TABLE 6

| | |
|---|---|
| First coil 31: | 200 μH |
| Second coil 32: | 390 μH |
| Self-resonance frequency of second coil 32: | 1.1 MHz |
| High frequency choking coil 52: | 2.2 μH |
| Self-resonance frequency of high frequency choking coil 52: | 90 MHz |
| Resistor 47: | 150 Ω |
| Resistor 49: | 2.7 kΩ |
| Capacitor 50: | 22 pF |
| Capacitor 51: | 1,000 pF |
| Choke coil 9: | 0.4 mH |
| Self-resonance frequency of choke coil 9 | 1.1 MHz |
| Stray capacitance of defogger 90: | 200 pF |
| Stray capacitance of antenna conductor 3: | 30 pF |
| Close capacitance of antenna conductor 3 and defogger 90: | 20 pF |
| Stray capacitance of cable 7a: | 45 pF |

Example 7

A glass sheet for a rear window for an automobile was used and a glass antenna device as shown in FIG. 9 was prepared. The damping resistors 20, 21 were not provided, and the locations corresponding to the resistors 20, 21 were opened. Further, the resistor 48 was not provided, and the location of the resistor 48 was short-circuited. The circuit constants of the elements were as shown in Table 7.

FIG. 15 is a characteristic diagram of frequency vs sensitivity in comparison with a pole antenna for a middle wave broadcast band. With respect to frequency-sensitivity characteristics in an FM broadcast band, the substantially same result as Example 1 was obtained.

TABLE 7

| | |
|---|---|
| First coil 31: | 120 μH |
| Second coil 32: | 560 μH |
| Self-resonance frequency of second coil 32: | 8 MHz |
| High frequency choking coil 52: | 2.2 μH |
| Self-resonance frequency of high frequency choking coil 52: | 90 MHz |
| Resistor 47: | 220 Ω |
| Resistor 49: | 10 kΩ |
| Capacitor 50: | 22 pF |
| Capacitor 51: | 220 pF |
| Choke coil 9: | 1.6 mH |
| Self-resonance frequency of choke coil 9 | 0.72 MHz |
| Stray capacitance of defogger 90: | 100 pF |
| Stray capacitance of antenna conductor 3: | 30 pF |
| Close capacitance of antenna conductor 3 and defogger 90: | 20 pF |
| Stray capacitance of cable 7a: | 120 pF |

According to the present invention, the first resonance is generated by a resonance element which comprises the impedance of the defogger and the inductance of the first coil, and the second resonance is generated by a resonance element which comprises the impedance of the defogger and the inductance of the second coil. Accordingly, the sensitivity in a low frequency band is excellent because resonance at two portions are utilized.

Further, the filter circuit is electrically connected between the antenna conductor and the defogger to block or attenuate received signals in a high frequency band. Accordingly, a possibility that received signals in the high frequency band excited in the antenna conductor leak to the automobile body as the earth or the like, can be reduced, and the reduction of sensitivity in the high frequency band can be prevented.

Even when both the inductance of the second inductance element and the inductance of the choke coil 9 are resonance elements for the second resonance, the resonance frequency for the second resonance can be changed by changing only the inductance of the second inductance element while the inductance of the choke coil 9 is not changed. Accordingly, the adjustment of the sensitivity in the low frequency band can easily be made.

What is claimed is:

1. A glass antenna device for an automobile, comprising:

a glass sheet sized to fit a rear window opening of an automobile;

an electric heating defogger Crowded on the glass sheet and having heater strips and bus bars configured to feed a current to the heater strips;

an antenna conductor provided on said glass sheet;

a choke coil connected between at least one of said bus bars and a d.c. power source, or between the at least one bus bar and a body of the automobile as a ground so that a signal in a first frequency band and a signal in a second frequency band which is higher in frequency than the first frequency band are received;

a receiver configured to receive a first signal in at least the first frequency band from the defogger which functions as an antenna that receives said first signal in at least the first frequency band and sends the first signal to the receiver, and to receive a second signal in at least the second frequency band from the antenna conductor which receives said second signal in at least the second frequency band and sends the second signal to the receiver;

a first inductance element electrically connected between the defogger and the receiver and between the antenna conductor and the defogger by interposing at least one of a signal line and a circuit element;

a second inductance element electrically connected between the defogger and the automobile body as a ground by interposing at least one of a signal line and a circuit element; and a filter circuit configured to perform one of blocking and attenuating a signal in the second frequency band and electrically connected between the antenna conductor and the defogger, wherein a first resonance is generated by a resonance element which comprises the impedance of the defogger and the inductance of the first inductance element, a second resonance is generated by a resonance element which comprises the impedance of the defogger and the inductance of the second inductance element, and the resonance frequency of the first resonance and the resonance frequency of the second resonance are such that the sensitivity of a signal in the first frequency band is increased.

2. The glass antenna device according to claim 1, wherein a serial connection circuit of the first inductance element and the filter circuit is electrically connected between the antenna conductor and the defogger by interposing at least one of a signal line and a circuit element.

3. The glass antenna device according to claim 1, wherein the first resonance is a series resonance and the second resonance is a parallel resonance.

4. The glass antenna device according to claim 1, wherein the second inductance element is electrically connected between the defogger and the automobile body as a ground by interposing at least one of a signal line and a circuit element, and a capacitor is electrically connected between an end at a defogger side of the second inductance element and the defogger by interposing at least one of a signal line and a circuit element.

5. The glass antenna device according to claim 1, wherein said filter circuit comprises a high frequency choking inductance element having an inductance value of 0.1–100 $\mu$H.

6. The glass antenna device according to claim 1, wherein the inductance of a parallel connection circuit of the second inductance element and the choke coil and the impedance of the defogger constitute mainly resonance elements for the second resonance, and the second resonance is a parallel resonance.

7. The glass antenna device according to claim 1, wherein the inductance value $L_2$ of the second inductance element and the inductance value $L_{CH}$ of the choke coil satisfy a relation of $1.5 \times L_2 \leqq L_{CH}$.

8. A glass antenna device for an automobile, comprising:

a glass sheet sized to fit a rear window opening of an automobile;

an electric heating defogger provided on the glass sheet and having heater strips and bus bars configured to feed a current to the heater strips;

an antenna conductor provided on said glass sheet;

a choke coil connected between at least one of said bus bars and a d.c. power source, or between the at least one bus bar and a body of the automobile as a ground;

a receiver connected to the antenna conductor by a cable so that a signal in a first frequency band and a signal in a second frequency band which is higher in frequency than the first frequency band are received by said receiver;

a first inductance element electrically connected between the defogger and the receiver and between the antenna conductor and the defogger by interposing at least one of a signal line and a circuit element;

a second inductance element electrically connected between the defogger and the automobile body as a ground by interposing at least one of a signal line and a circuit element; and a filter circuit configured to perform one of blocking and attenuating a signal in the second frequency band and electrically connected between the antenna conductor and the defogger, wherein the defogger functions as an antenna which receives a first signal in at least the first frequency band and sends the fiat signal to the receiver, and the antenna conductor receives a second signal in at least the second frequency band and sends the signal to the receiver, a first resonance is generated by a resonance element which comprises the impedance of the defogger and the inductance of the first inductance element, a second resonance is generated by a resonance element which comprises the impedance of the cable and the inductance of the second inductance element, the resonance frequency of the first resonance and the resonance frequency of the second resonance are such that the sensitivity of signal in the first frequency band is high.

9. The glass antenna device according to claim 8, wherein a serial connection circuit of the first inductance element and the filter circuit is electrically connected between the antenna conductor and the defogger by interposing at least one of a signal line and a circuit element.

10. The glass antenna device according to claim 8, wherein the first resonance is a series resonance and the second resonance is a parallel resonance.

11. The glass antenna device according to claim 8, wherein the second inductance element is electrically connected between the defogger and the automobile body as a ground by interposing at least one of a signal line and a circuit element, and a capacitor is electrically connected between an end at a defogger side of the second inductance element and the defogger by interposing at least one of a signal line and a circuit element.

12. The glass antenna device according to claim 8, wherein said filter circuit comprises a high frequency choking inductance element having an inductance value of 0.1–100 $\mu$H.

13. The glass antenna device according to claim 8, wherein the inductance of a parallel connection circuit of the second inductance element and the choke coil and the impedance of the defogger constitute mainly resonance elements for the second resonance, and the second resonance is a parallel resonance.

14. The glass antenna device according to claim 8, wherein the inductance value $L_2$ of the second inductance element and the inductance value $L_{CH}$ of the choke coil satisfy a relation of $1.5 \times L_2 \leqq L_{CH}$.

15. A glass antenna device for an automobile, comprising:

a glass sheet sized to fit a rear window opening of an automobile;

an electric heating defogger provided on the glass sheet and having heater strips and bus bars configured to feed a current to the heater strips;

an antenna conductor provided on said glass sheet;

a choke coil connected between at least one of said bus bars and a d.c. power source, or between the at least one bus bar and a body of the automobile as a ground so that a signal in a first frequency band and a signal in a second frequency band which is higher in frequency than the first frequency band are received;

a first inductance element as a resonance element for generating a first resonance; and a second inductance element, wherein the inductance of the second inductance element, the inductance of the choke coil and the impedance of the defogger are included as resonance elements for the second resonance, the resonance frequency of the first resonance and the resonance frequency of the second resonance are such that the sensitivity of signal in the first frequency band is high, and the first inductance element is electrically connected between the defogger and the receiver and between the antenna conductor and the defogger by interposing at least one of a signal line and a circuit element.

16. The glass antenna device according to claim 15, wherein the inductance of a parallel connection circuit of the second inductance element and the choke coil and the impedance of the defogger constitute mainly resonance elements for the second resonance, and the second resonance is a parallel resonance.

17. The glass antenna device according to claim 15, wherein the inductance value $L_2$ of the second inductance element and the inductance value $L_{CH}$ of the choke coil satisfy a relation of $1.5 \times L_2 \leqq L_{CH}$.

18. A glass antenna device for an automobile, comprising:

a glass sheet sized to fit a rear window opening of an automobile;

an electric heating defogger provided on the glass sheet and having heater strips and bus bars configured to feed a current to the heater strips;

an antenna conductor provided on said glass sheet;

a choke coil connected between at least one of said bus bars and a d.c. power source, or between the bus bar and a the automobile as a ground so that a signal in a first frequency band and a signal in a second frequency band which is higher in frequency than the first frequency band are received, wherein a receiver configured to receive a first signal in at least the first frequency band from the defogger which functions as an antenna that receives said first signal in at least the first frequency band and sends the first signal to the receiver, and to receive a second signal in at least the second frequency band from the antenna conductor which receives said second signal in at least the second frequency band and sends the second signal to the receiver;

a filter circuit configured to perform one of blocking and attenuating a signal in the second frequency band and a first inductance element electrically connected between a signal line connecting the antenna conductor to the receiver and the defogger by interposing at least one of a signal line and a circuit element a second inductance element electrically connected between a signal line connecting the defogger to the receiver and the automobile body as the ground by interposing at least one of a line and a circuit element.

19. The glass antenna device according to claim 18, wherein the second inductance element is electrically connected between the defogger and the automobile body as a ground by interposing at least one of a signal line and a circuit element, and a capacitor is electrically connected between an end at a defogger side of the second inductance element and the defogger by interposing at least one of a signal line and a circuit element.

20. The glass antenna device according to claim 18, wherein said filter circuit comprises a high frequency choking inductance element having an inductance value of 0.1–100 $\mu$H.

21. The glass antenna device according to claim 18, wherein the inductance of a parallel connection circuit of the second inductance element and the choke coil and the impedance of the defogger constitute mainly resonance elements for the second resonance, and the second resonance is a parallel resonance.

22. The glass antenna device according to claim 18, wherein the inductance value $L_2$ of the second inductance element and the inductance value $L_{CH}$ of the choke coil satisfy a relation of $1.5 \times L_2 \leqq L_{CH}$.

23. A glass antenna device for an automobile, comprising:

a glass sheet sized to fit a rear window opening of an automobile;

an electric heating defogger provided on the glass sheet and having heater strips and bus bars configured to feed a current to the heater strips;

an antenna conductor provided on said glass sheet;

a choke coil connected between at least one of said bus bars and a d.c. power source, or between the at least one bus bar and a body of the automobile as a ground;

a receiver connected to the antenna conductor by a cable so that a signal in a first frequency band and a signal in a second frequency band which is higher in frequency than the first frequency band are received, a first inductance element as a resonance element for generating a first resonance; and a second inductance element, wherein the inductance of the second inductance element and the stray capacitance of the cable are resonance elements for generating a second resonance, the stray capacitance of the cable is 50–300 pF, and the resonance frequency of the first resonance and the resonance frequency of the second resonance are such that the sensitivity of signal in the first frequency band is high.

24. The glass antenna device according to claim 23, wherein the inductance value $L_2$ of the second inductance element and the inductance value $L_{CH}$ of the choke coil satisfy a relation of $1.5 \times L_2 \leqq L_{CH}$.

* * * * *